US010943575B2

(12) United States Patent
Ishida et al.

(10) Patent No.: US 10,943,575 B2
(45) Date of Patent: Mar. 9, 2021

(54) SOUND ABSORBING DEVICE, ELECTRONIC DEVICE, AND IMAGE FORMING APPARATUS

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 16/884,508

(22) Filed: May 27, 2020

(65) Prior Publication Data

US 2020/0286458 A1 Sep. 10, 2020

Related U.S. Application Data

(63) Continuation of application No. 16/415,450, filed on May 17, 2019, now Pat. No. 10,720,134, which is a continuation of application No. 15/915,395, filed on Mar. 8, 2018, now Pat. No. 10,332,500, which is a continuation of application No. 15/307,133, filed as (Continued)

(30) Foreign Application Priority Data

| | | |
|---|---|---|
| Apr. 28, 2014 | (JP) | 2014-092789 |
| Jul. 30, 2014 | (JP) | 2014-155065 |
| Apr. 9, 2015 | (JP) | 2015-080100 |

(51) Int. Cl.

| | |
|---|---|
| ***G03G 15/00*** | (2006.01) |
| ***G10K 11/00*** | (2006.01) |
| ***B41J 29/08*** | (2006.01) |
| ***G03G 21/16*** | (2006.01) |
| ***G10K 11/172*** | (2006.01) |

(Continued)

(52) U.S. Cl.

CPC ..... *G10K 11/002* (2013.01); *B41J 29/02* (2013.01); *B41J 29/08* (2013.01); *B41J 29/13* (2013.01); *G03G 21/1619* (2013.01); *G10K 11/172* (2013.01)

(58) Field of Classification Search

CPC ..... G03G 21/1619; G10K 11/172

USPC ..... 399/91

See application file for complete search history.

(56) References Cited

U.S. PATENT DOCUMENTS

| | | | |
|---|---|---|---|
| 4,501,341 | A | 2/1985 | Jones |
| 5,508,477 | A | 4/1996 | Kato et al. |

(Continued)

FOREIGN PATENT DOCUMENTS

| | | | |
|---|---|---|---|
| CN | 101727894 | A | 6/2010 |
| CN | 102047320 | A | 5/2011 |

(Continued)

OTHER PUBLICATIONS

International Search Report dated Jul. 28, 2015 in PCT/JP2015/063401 filed on Apr. 28, 2015.

(Continued)

*Primary Examiner* — William J Royer

(74) *Attorney, Agent, or Firm* — Harness, Dickey and Pierce, P.L.C.

(57) ABSTRACT

A sound absorbing device includes: a plurality of sound absorbing units. A frequency of sound absorbed by at least one of the sound absorbing units overlaps, at least partially, with a frequency of sound with a volume increased by installation of another sound absorbing unit.

7 Claims, 12 Drawing Sheets

Related U.S. Application Data application No. PCT/JP2015/063401 on Apr. 28, 2015, now Pat. No. 9,972,298.

(51) Int. Cl.
*B41J 29/02* (2006.01)
*B41J 29/13* (2006.01)

(56) References Cited

U.S. PATENT DOCUMENTS

| | | | | |
|---|---|---|---|---|
| 5,598,479 | A | 1/1997 | Dodt et al. | |
| 5,783,780 | A | 7/1998 | Watanabe et al. | |
| 6,021,612 | A | 2/2000 | Dunn et al. | |
| 7,136,605 | B2 | 11/2006 | Tsunoda et al. | |
| 8,474,574 | B1 | 7/2013 | Kobayashi et al. | |
| 8,731,224 | B2 | 5/2014 | Shiozawa et al. | |
| 9,671,718 | B2 | 6/2017 | Ishida et al. | |
| 9,972,298 | B2 | 5/2018 | Ishida et al. | |
| 10,332,500 | B2 | 6/2019 | Ishida et al. | |
| 10,720,134 | B2 * | 7/2020 | Ishida et al. ..... | G03G 21/1619 |
| 2008/0113538 | A1 | 5/2008 | Masuda | |
| 2011/0206228 | A1 | 8/2011 | Shiozawa et al. | |
| 2012/0247867 | A1 | 10/2012 | Yang | |
| 2013/0008739 | A1 | 1/2013 | Nishio et al. | |

FOREIGN PATENT DOCUMENTS

| | | | |
|---|---|---|---|
| EP | 2362679 | A2 | 8/2011 |
| JP | S63195398 | U | 12/1988 |
| JP | H 5-232967 | A | 9/1993 |
| JP | H07-181978 | A | 7/1995 |
| JP | H07285306 | A | 10/1995 |
| JP | H 08083038 | A | 3/1996 |
| JP | H 09144986 | | 6/1997 |
| JP | 2000-112306 | A | 4/2000 |
| JP | 2000-235396 | A | 8/2000 |
| JP | 3317936 | B2 | 8/2002 |
| JP | 2003328326 | A | 11/2003 |
| JP | 3816678 | B2 | 8/2006 |
| JP | 2006-292231 | A | 10/2006 |
| JP | 3132920 | U | 6/2007 |
| JP | 2007146852 | A | 6/2007 |
| JP | 4032984 | B2 | 1/2008 |
| JP | 4799355 | B2 | 10/2011 |
| JP | 2012128230 | A | 7/2012 |
| JP | 2013015118 | A | 1/2013 |
| JP | 2016-033649 | A | 3/2016 |
| KR | 1020130014847 | A | 4/2013 |
| WO | WO-2013/064602 | A1 | 5/2013 |

OTHER PUBLICATIONS

Nakai, Takayoshi, Yoshida, Kota, Mori, Satoshi, "Frequency characteristics with pole-zero pairs for Helmholtz resonators", 2012 Autumn Meeting Acoustical Society of Japan, Acoustical Society of Japan, Sep. 11, 2012, pp. 1151-1152 with English translation of relevant part.

Written Opinion of the International Searching Authority PCT/ISA/237 for International Application No. PCT/JP2015/063401 dated Jul. 28, 2015, filed on Apr. 28, 2015.

Singapore Written Opinion dated May 11, 2017 issued in corresponding Singapore Application No. 11201608853Q.

Extended European Search Report dated Sep. 6, 2017 issued in corresponding European Application No. 15785729.3.

Korean Office Action dated Mar. 20, 2018 for Korean Application No. 10-2016-7030367.

First Office Action dated Mar. 19, 2019 for corresponding Chinese Application No. 201580021492.5.

Japanese Office Action dated Apr. 10, 2020 for JP Application No. 2019-080728.

* cited by examiner

SOUND ABSORBING DEVICE, ELECTRONIC DEVICE, AND IMAGE FORMING APPARATUS

This application is a continuation application of U.S. application Ser. No. 16/415,450, filed on May 17, 2019, which is a continuation application of U.S. application Ser. No. 15/915,395, filed on Mar. 8, 2018, which is a continuation application of U.S. application Ser. No. 15/307,133, filed on Oct. 27, 2016, which is a national phase under 35 U.S.C. § 371 of PCT International Application PCT/JP2015/063401, filed on Apr. 28, 2015, and claims priority under 35 U.S.C. 119 to Japanese Patent Application No. 2014-092789, filed on Apr. 28, 2014; Japanese Patent Application No. 2014-155065, filed on Jul. 30, 2014; and, Japanese Patent Application No. 2015-080100, filed on Apr. 9, 2015, in the Japanese Patent Office, the entire contents of each of which are hereby incorporated by reference herein.

TECHNICAL FIELD

The present invention relates to a sound absorbing device that includes a Helmholtz resonator, and to an electronic device and an image forming apparatus using the sound absorbing device.

BACKGROUND ART

An electrophotographic image forming apparatus generates sound such as driving sound from various driving units or sound from a rotating polygon mirror during image forming operations. Patent Document 1 and Patent Document 2 disclose an image forming apparatus including a sound absorbing device that includes a Helmholtz resonator as an exemplary structure capable of absorbing sound generated during image formation.

A Helmholtz resonator has a cavity with a certain volume, and a communicating portion that communicates the cavity to the external. Denoting the volume of the cavity by "V", denoting the surface area of the opening of the communicating portion by "S", denoting the length of the communicating portion in the communicating direction by "H", and denoting the speed of sound by "c", the frequency "f" of the sound absorbed by a sound absorbing device that includes a Helmholtz resonator can be calculated as Equation (1) below.

$$f = \frac{c}{2\pi}\sqrt{\frac{S}{V(H+\Delta r)}} \tag{1}$$

($\Delta r$: opening end correction)

The inventors of the present invention discovered that, through keen examination, the sound absorbing devices provided with a Helmholtz resonator have a problem, which will now be described.

While a sound absorbing device with a Helmholtz resonator absorbing sound at a particular frequency has been capable of reducing the volume of the sound at that frequency of the sound absorbed by the Helmholtz resonator, unfortunately, the sound absorbing device has increased the volume of the sound at a frequency outside of the frequency of the sound absorbed by the Helmholtz resonator to a level higher than that without the sound absorbing device. Such a phenomenon may also occur in a sound absorbing device having a sound absorbing unit that is not a Helmholtz resonator.

In view of the above, there is a need to provide a sound absorbing device that includes a sound absorbing unit and in which a volume increase of the sound of frequencies outside the frequency of the sound absorbed by the sound absorbing unit can be suppressed, and to provide an electronic device and an image forming apparatus that include the sound absorbing device.

BRIEF DESCRIPTION OF DRAWINGS

FIG. 15A is a schematic for explaining the sound absorbing body member assembled with a sound absorbing cover member; and FIG. 15B is an exploded view.

FIG. 19A is a schematic for explaining a sound absorbing body member assembled with a sound absorbing cover member; and FIG. 19B is an exploded view.

DESCRIPTION OF EMBODIMENTS

An electrophotographic copier (hereinafter, simply referred to as "copier 500") will now be explained, as an embodiment of an image forming apparatus according to the present invention. In this embodiment, a monochrome image forming apparatus is used as an exemplary copier 500, but the copier may also be a known color image forming apparatus.

To begin with, the structure of the copier 500 will now be explained.

Figure 2:
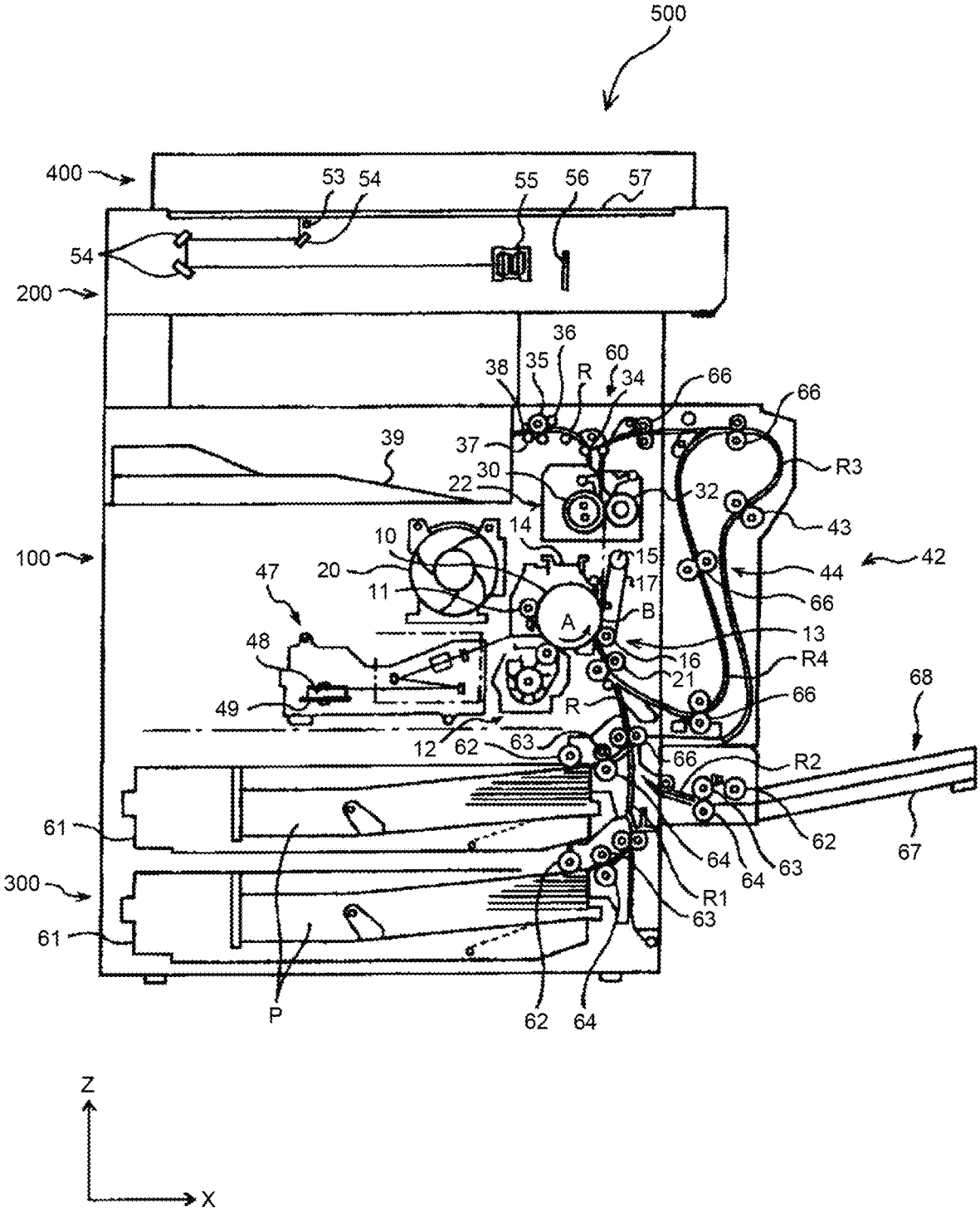
FIG. 2 is a schematic of structure of a copier according to an embodiment.

FIG. 2 is a schematic of structure of the entire copier 500 according to the embodiment. In FIG. 2, an image reading device 200 is mounted on a copier body 100 of the copier 500, and the copier body 100 is disposed on a recording sheet bank 300. An automatic document feeder 400 that is rotatable about a fulcrum on the rear side (rear side in the drawing) is mounted on the top of the image reading device 200.

Figure 3:
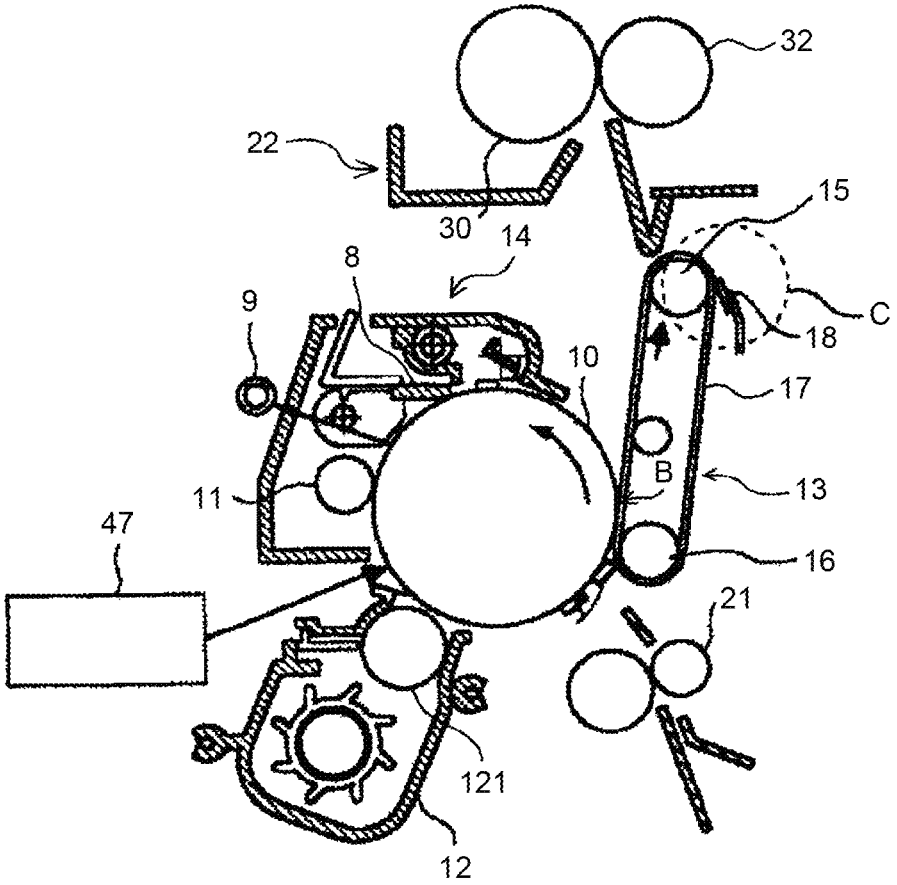
FIG. 3 is a schematic of structure around a photoconductor in the copier.

A drum-shaped photoconductor 10 serving as a latent image bearer is provided inside the copier body 100. FIG. 3 is an enlarged view of structure around the photoconductor 10. As illustrated in FIG. 3, a neutralizing lamp 9, a charging unit 11 using a charging roller, a developing device 12, a transfer unit 13, and a cleaning unit 14 having a photoconductor cleaning blade 8 are disposed around the photoconductor 10. The developing device 12 uses polymerization toner produced through polymerization, and turns an electrostatic latent image on the photoconductor 10 into a visible image by attaching the polymerization toner onto the electrostatic latent image, using a developing roller 121 serving as a developer bearer.

The transfer unit 13 includes a transfer belt 17 stretched across two roller members that are a first belt stretching roller 15 and a second belt stretching roller 16. The transfer belt 17 is pressed against the circumferential surface of the photoconductor 10 at a transfer position B.

Foreign substances such as residual toner or paper powder remaining on the transfer belt 17 after a recording sheet P is separated from the transfer belt 17 are scraped off by a belt cleaning blade 18. The belt cleaning blade 18 is provided to a transfer belt cleaning unit C, and abuts against the first belt stretching roller 15 across the transfer belt 17.

Figure 1:
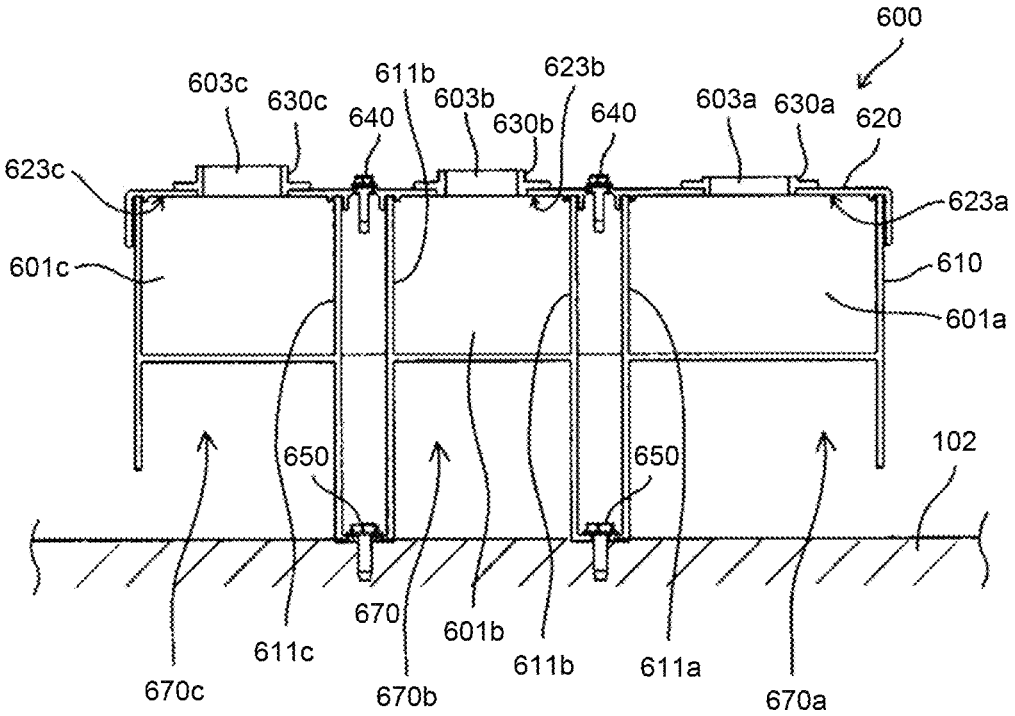
FIG. 1 is a schematic cross-sectional view of a sound absorbing device according to a first embodiment of the present invention.

The copier body 100 also includes, at the left of the charging unit 11 and the cleaning unit 14 in FIG. 1, a toner supply unit 20 supplying new toner to the developing device 12.

The copier body 100 also includes a recording sheet conveying unit 60 for conveying a recording sheet P taken out from a recording sheet cassette 61 provided to the recording sheet bank 300, to the transfer position B, and to an ejection stack unit 39. This recording sheet conveying unit 60 conveys a recording sheet P along a feed path R1 or a manual feed path R2, and along a recording sheet conveying path R. On the recording sheet conveying path R, a registration roller pair 21 is provided upstream of the transfer position B in the recording sheet conveying direction.

A thermal fixing unit 22 is provided downstream of the transfer position B in the recording sheet conveying direction along the recording sheet conveying path R. The thermal fixing unit 22 includes a heating roller 30 that is a heating member, and a pressing roller 32 that is a pressing member, and fixes the image onto the recording sheet P with heat and pressure, by nipping the recording sheet P between these two rollers.

An ejecting bifurcating claw 34, an ejecting roller 35, a first pressing roller 36, a second pressing roller 37, and a sheet-stiffening roller 38 are provided further downstream of the thermal fixing unit 22 in the recording sheet conveying direction. The ejection stack unit 39 in which recording sheets P passed through the thermal fixing unit 22 after the image formation are stacked is also provided.

The copier body 100 also includes a switchback unit 42 positioned at the right in FIG. 2. The switchback unit 42 conveys a recording sheet P along a reversing path R3 branched off at the position of the ejecting bifurcating claw 34 in the recording sheet conveying path R, and a re-conveying path R4 guiding the recording sheet P passed through the reversing path R3 again into the position of the registration roller pair 21 in the recording sheet conveying path R. The reversing path R3 is provided with a switchback roller pair 43, and the re-conveying path R4 is provided with a plurality of recording sheet conveyance roller pairs 66.

As illustrated in FIG. 2, the copier body 100 includes a laser writing device 47 at the left of the developing device 12 in FIG. 1. The laser writing device 47 includes a scanning optical system that includes a laser light source, a polygon mirror 48 that is a polygon mirror for scanning, a polygon motor 49, and an fθ lens.

The image reading device 200 includes a light source 53, a plurality of mirrors 54, an image forming optical lens 55, and an image sensor 56 such as a charge-coupled device (CCD) image sensor. A contact glass 57 is provided on the top surface of the image reading device 200.

The automatic document feeder 400 has an original holder, and an original stack holder is provided at the position at which the original is ejected. The automatic document feeder 400 includes a plurality of original conveying rollers, and the original conveying rollers conveys an original from the original holder into a scanned position on the contact glass 57 of the image reading device 200, and onto the original stack holder.

The recording sheet bank 300 includes a plurality of recording sheet cassettes 61 provided one on top of another and storing therein recording sheets P that are recording media such as paper or overhead projector (OHP) films. Each of the recording sheet cassettes 61 includes a calling roller 62, a supplying roller 63, and a separating roller 64. At the right of the recording sheet cassettes 61 in FIG. 2, the feed path R1 explained above and connected to the recording sheet conveying path R in the copier body 100 is provided. The feed path R1 also includes some recording sheet conveyance roller pairs 66 for conveying a recording sheet P.

The copier body 100 includes a manual feed unit 68 at the right in FIG. 2. The manual feed unit 68 is provided with a manual feed tray 67 that can be opened and closed. The manual feed path R2 described above leads a recording sheet P placed on the manual feed tray 67 into the recording sheet conveying path R. The manual feed unit 68 also has a calling roller 62, a supplying roller 63, and a separating roller 64, similarly to the recording sheet cassette 61.

An operation of the copier 500 will now be explained.

To make a copy using the copier 500, to begin with, a user turns on a main switch, and places an original on the original holder on the automatic document feeder 400. When the original has a book-like shape, the user opens the automatic document feeder 400, and places the original directly onto the contact glass 57 of the image reading device 200, closes the automatic document feeder 400, and causes the automatic document feeder 400 to hold down the original.

When the user then presses a start switch, the original conveying rollers move the original onto the contact glass 57 via the original conveying path, and the image reading device 200 is driven in the case where the original is set in the automatic document feeder 400. The image reading device 200 then reads the original, and ejects the original onto the original stack holder.

When the original is placed directly onto the contact glass 57, the image reading device 200 is driven immediately, and reads the original.

To read the original, the image reading device 200 causes the light source 53 to emit light to the surface of the original on the contact glass 57, while moving the light source 53 along the contact glass 57. The mirrors 54 guide the reflected light onto the image forming optical lens 55, and the light enters the image sensor 56. The image sensor 56 then reads the image of the original.

At the same time as the image reading device 200 is caused to read the original, a photoconductor driving motor, in the copier 500 rotates the photoconductor 10. The charging unit 11 then charges the surface of the photoconductor 10 uniformly to, for example, −1000 volt or so. The laser writing device 47 then emits a laser beam onto the photoconductor 10 based on the image of the original read by the image reading device 200, thereby performing writing with the laser, and forming an electrostatic latent image on the surface of the photoconductor 10. The surface potential of the portion irradiated with the laser beam (latent image portion) becomes, for example, 0 to −200 volt. The developing device 12 then attaches the toner onto the electrostatic latent image, thereby turning the electrostatic latent image into a visible image.

At the same timing as the start switch is pressed, the calling roller 62 in the copier 500 feeds recording sheets P of a size selected by the user, from one of the recording sheet cassettes 61 in the recording sheet bank 300. The supplying roller 63 and the separating roller 64 then separate one of the fed recording sheets P, and guide the separated recording sheet P into the feed path R1. The recording sheet conveyance roller pairs 66 then guide the recording sheet P into the recording sheet conveying path R. The recording sheet P conveyed into the recording sheet conveying path R abuts against the registration roller pair 21 and is stopped thereby.

When the manual feed unit 68 is used, the user opens the manual feed tray 67 and places recording sheets P on the manual feed tray 67. The calling roller 62, the supplying roller 63, and the separating roller 64 separate one of the recording sheets P placed on the manual feed tray 67, conveys the recording sheet P into the manual feed path R2, similarly to when the recording sheet cassette 61 is used. The recording sheet conveyance roller pairs 66 then guides the recording sheet P into the recording sheet conveying path R. The recording sheet P guided into the recording sheet conveying path R abuts against the registration roller pair 21 and is stopped thereby.

The registration roller pair 21 starts rotating to match the timing at which the leading end of the toner image that is a visible image on the photoconductor 10 enters the transfer position B, and the recording sheet P stopped by the registration roller pair 21 is fed into the transfer position B.

The transfer unit 13 transfers the toner image on the photoconductor 10 onto the recording sheet P fed into the transfer position B, and the toner image is carried on the surface of the recording sheet P. The cleaning unit 14 cleans the residual toner on the surface of the photoconductor 10 after the transfer, and the neutralizing lamp 9 neutralizes the residual potential of the photoconductor 10. Through this neutralization of the residual potential, the surface potential is neutralized to the reference potential from 0 to −150 volt, thereby preparing for the next image formation starting from the charging unit 11.

The transfer belt 17 then conveys the recording sheet P carrying the toner image into the thermal fixing unit 22. The heating roller 30 and pressing roller 32 carry the recording sheet P nipped therebetween, while applying heat and pressure to the recording sheet P, thereby fixing the toner image onto the recording sheet P. The recording sheet P is then stiffened by the ejecting roller 35, the first pressing roller 36, the second pressing roller 37, and the sheet-stiffening roller 38, and ejected onto and stacked on the ejection stack unit 39.

When images are to be formed on both sides of the recording sheet P, the ejecting bifurcating claw 34 is switched after the toner image is transferred and fixed onto one side of the recording sheet P, and the recording sheet P is conveyed from the recording sheet conveying path R into the reversing path R3. The recording sheet conveyance roller pair 66 then conveys the recording sheet P entering the reversing path R3 into a switchback position 44, and the switchback roller pair 43 causes the recording sheet P to switchback to the re-conveying path R4. The recording sheet conveyance roller pair 66 then guides the recording sheet P into the recording sheet conveying path R again. A toner image is then transferred onto the opposite side of the recording sheet P having passed through the re-conveying path R4.

Figure 4:
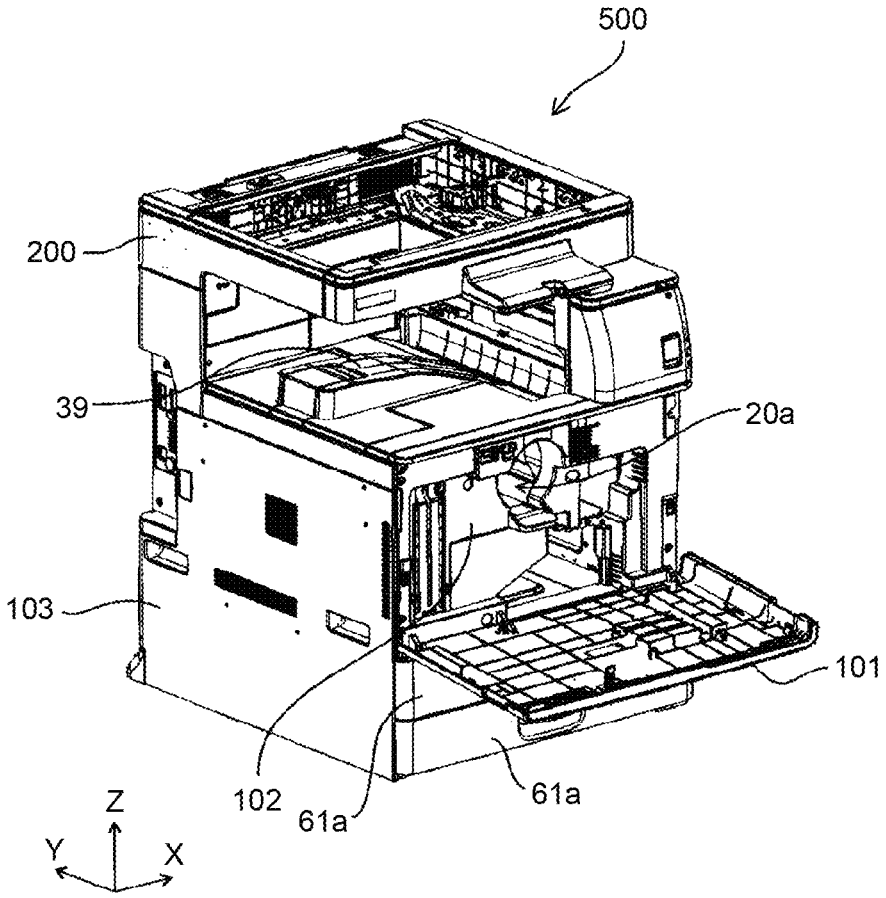
FIG. 4 is a perspective view for explaining a copier with an openable front cover opened.

FIG. 4 is a perspective view for explaining the copier 500 with an openable front cover 101 opened.

The copier 500 illustrated in FIG. 4 is in the state where the automatic document feeder 400 and the optical system inside the image reading device 200 are removed. By opening the openable front cover 101 that is an outer cover, a front inner cover 102 that is an interior cover is exposed. The copier 500 illustrated in FIG. 4 is in the state where the toner bottle included in the toner supply unit 20 is also removed, and a bottle setting hole 20*a* of the front inner cover 102 into which a toner bottle is inserted is vacant. Below the openable front cover 101 of the copier 500, a recording sheet cassette outer cover 61*a* with a handle for pulling out the recording sheet cassette 61 is provided.

Figure 5:
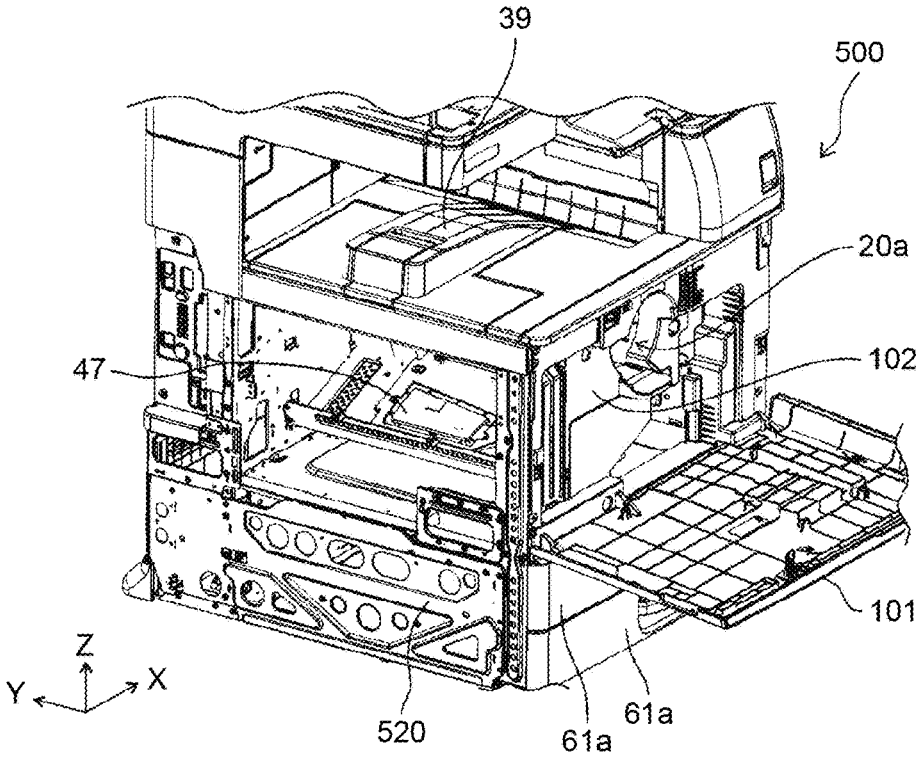
FIG. 5 is a perspective view of the copier with a left side outer cover removed from the state illustrated in FIG. 4.
Figure 6:
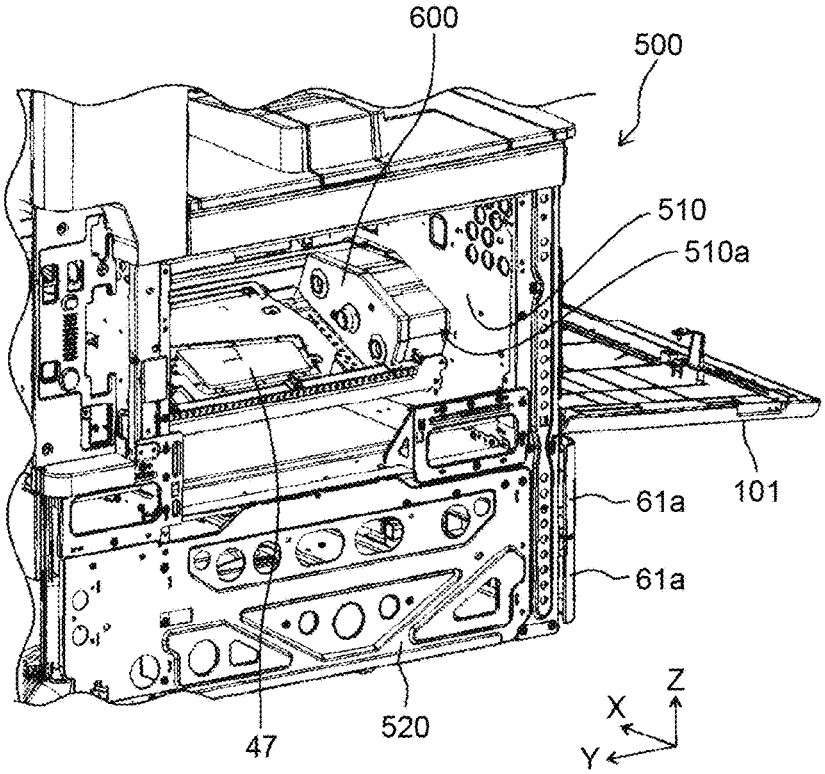
FIG. 6 is a perspective view for explaining the copier in the state illustrated in FIG. 5, viewed from a viewpoint where the inner surface of a front housing forming plate to which a front inner cover is fixed is visible.

FIG. 5 is a perspective view of the copier 500 with a left side outer cover 103 removed from FIG. 4, and with a left housing 520 exposed. FIG. 6 is a perspective view for explaining the copier 500 in a configuration illustrated in FIG. 5, viewed from a viewpoint where the inner surface of a front housing 510 that is provided inside the front inner cover 102 and to which the front inner cover 102 is fixed is visible.

As illustrated in FIG. 6, the copier 500 includes a sound absorbing device 600 that includes Helmholtz resonators at a position facing the laser writing device 47 inside the front surface.

Figure 7:
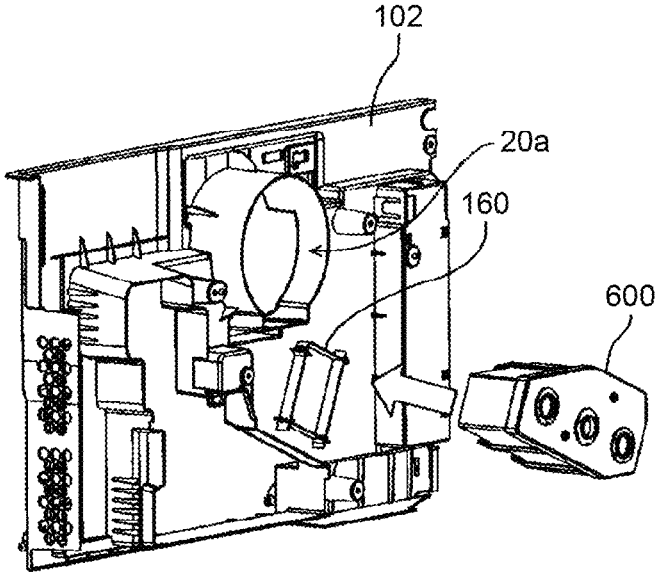
FIG. 7 is a schematic for explaining the position at which the sound absorbing device is attached on the front inner cover.

FIG. 7 is a schematic for explaining the position at which the sound absorbing device 600 is attached on the front inner cover 102. As illustrated in FIG. 7, a sound absorbing device attaching portion 160 is provided to the inner surface of the front inner cover 102. The sound absorbing device 600 is then attached and fixed to the sound absorbing device attaching portion 160 from a direction of the arrow in FIG. 7. The front inner cover 102 is then fixed onto the front housing 510. As a result, the sound absorbing device 600 protrudes internally through a sound absorbing device attaching opening 510*a* that is an opening formed on the front housing 510, as illustrated in FIG. 6. The sound absorbing device 600 is a sound absorbing device that includes a Helmholtz resonator.

Figure 8:
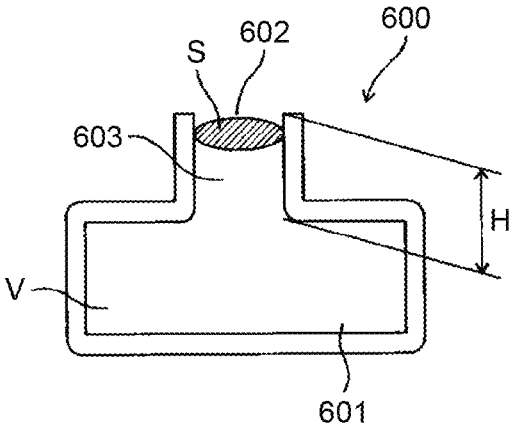
FIG. 8 is a schematic of a sound absorbing device that includes a Helmholtz resonator.

FIG. 8 is a schematic of the sound absorbing device 600 that includes a Helmholtz resonator.

As illustrated in FIG. 8, a Helmholtz resonator has a shape of a vessel with a narrow opening and a cavity 601 with a volume, and a communicating portion 603 that is smaller than the cavity 601. The Helmholtz resonator absorbs the sound at a particular frequency coming through the communicating portion 603.

Denoting the volume of the cavity 601 by "V", the surface area of an opening 602 of the communicating portion 603 by "S", the length of the communicating portion 603 by "H", the speed of sound by "c", and the frequency of the sound absorbed by the sound absorbing device 600 by "f", the following Equation (1) is established.

$$f = \frac{c}{2\pi}\sqrt{\frac{S}{V(H+\Delta r)}} \tag{1}$$

($\Delta r$: open end correction)

"Δr" in Equation (1) denotes an open end correction, and generally "Δr=0.6 r" is used, where "r" is the radius when assuming that the cross section of the communicating portion 603 is circular.

As indicated by Equation (1), the frequency of sound absorbed by the sound absorbing device 600 can be calculated from the volume V of the cavity 601, the length H of the communicating portion 603, and the surface area S of the opening of the communicating portion 603.

The copier 500 generates various types of sound such as sound generated by driving a driving motor transmitting a driving force to rotate various rollers, sound generated by the movements of moving members such as various rollers, and sound generated by the rotations of the polygon mirror 48 in the laser writing device 47. These types of sound is emitted outside of the copier 500, and may become a noise giving the sense of discomfort to the people around the copier 500. By manufacturing the sound absorbing device 600 in a manner suitable for the frequency of sound the transmission of which to the external is desirably to be suppressed, among those types of sound that may be a noise, the sound absorbing device 600 can absorb the sound that may be a noise.

Because the copier 500 has an outer cover, the outer cover can suppress the leakage of sound to some extent. The inventors of the present invention discovered that, through keen examination, while the outer cover is capable of sufficiently suppressing the leakage of sound at somewhat high frequencies, e.g., those higher than 1500 hertz, to the external, the outer cover is incapable of sufficiently suppressing the sound at low frequencies equal to or lower than 1500 hertz to the external.

Therefore, by setting the frequency of the sound to be absorbed by the sound absorbing device 600 that includes a Helmholtz resonator (absorbed sound frequency) equal to or lower than 1500 hertz, the sound absorbing device 600 can suppress the leakage of the sound at frequencies that cannot be suppressed by the outer cover.

For reasons such as that human ears pick up low-frequency sound less, that the majority of problematic noises from an ordinary image forming apparatus is 200 hertz or higher, and that it is difficult to design a sound absorbing device absorbing sound of a frequency equal to or lower than 100 hertz, the sound absorbing device 600 is designed to absorb the frequency equal to or higher than 100 hertz.

First Embodiment

A sound absorbing device 600 according to a first embodiment will now be explained.

Figure 9:
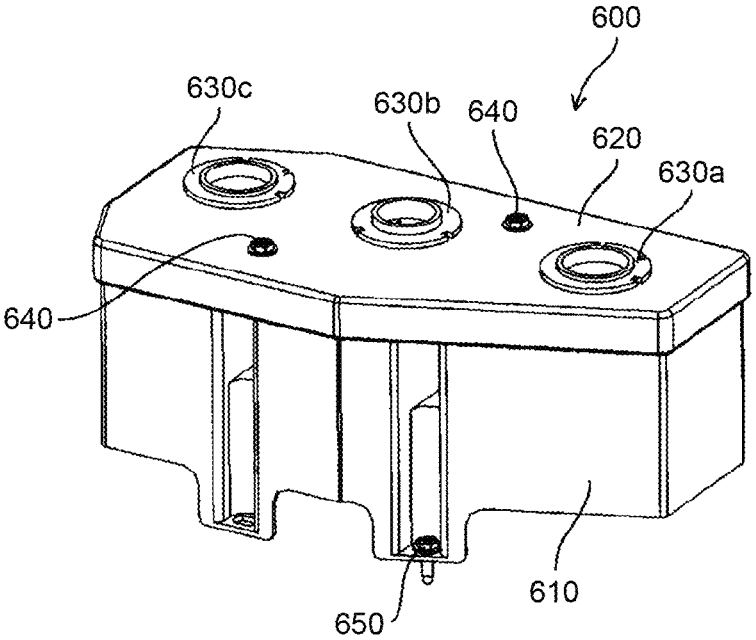
FIG. 9 is an enlarged perspective view of the sound absorbing device according to the first embodiment.

FIG. 9 is an enlarged perspective view of the sound absorbing device 600 according to the first embodiment, and FIG. 1 is a schematic cross-sectional view of the sound absorbing device 600 according to the first embodiment attached to the front inner cover 102. The sound absorbing device 600 according to the first embodiment is the sound absorbing device 600 illustrated in FIGS. 6 and 7 but having characterizing features according to the embodiment. As illustrated in FIGS. 9 and 1, the sound absorbing device 600 is a sound absorbing device made up from three members that are a sound absorbing body member 610, a sound absorbing cover member 620, and a sound absorbing cap member 630*a* to 630*c*. The sound absorbing cover member 620 is fixed to the sound absorbing body member 610 with cover fixing screws 640, and the sound absorbing body member 610 is fixed to the front inner cover 102 with body fixing screws 650.

As illustrated in FIG. 1, in the sound absorbing device 600, three Helmholtz resonators 670 (a first resonator 670*a*, a second resonator 670*b*, and a third resonator 670*c*) are formed by the sound absorbing cover member 620 and the sound absorbing body member 610 that are provided as a pair.

The sound absorbing body member 610 has body side wall portions (611*a* to 611*c*) each forming a side surface of the cavities 601 (601*a* to 601*c*) of the Helmholtz resonators 670. The sound absorbing cover member 620 also has a cavity top portion (623*a* to 623*c*) forming the top surface of the cavities 601 (601*a* to 601*c*) of the Helmholtz resonators 670. The sound absorbing cover member 620 has three openings, and the sound absorbing cap members 630*a* to 630*c* are inserted in the three respective openings.

In the sound absorbing device 600 illustrated in FIG. 1, the sound absorbing cover member 620 forms a wall provided with the communicating portions 603 (603*a* to 603*c*), and is provided as a separate member from the sound absorbing cap members 630*a* to 630*c* that form the communicating portions 603. This design allows the sound absorbing cap members 630*a* to 630*c* to be replaced with another sound absorbing cap members having a different shape, so that the length H of the communicating portion 603 and the surface area S of the opening of the communicating portion 603 in Equation (1) can be changed easily. In this manner, the absorbed sound frequencies can be changed at low costs.

The sound absorbing device 600 that includes Helmholtz resonators absorbs sound at particular frequencies as a countermeasure for noise in an electronic device. An image forming apparatus achieving a plurality of printing speeds emits sound, possibly being a noise, at different frequencies depending on the printing speed. The sound absorbing device 600 has the structure in which the sound absorbing cap members 630*a* to 630*c* are provided as separate members from the sound absorbing body member 610 that forms the walls defining the cavities 601 and the sound absorbing cover member 620. In such a sound absorbing device 600, the absorbed sound frequencies can be changed accordingly to the respective printing speeds inexpensively, merely by replacing the sound absorbing cap members 630*a* to 630*c*.

Furthermore, in the structure in which the walls defining the cavities 601 are formed by two members of the sound absorbing body member 610 and the sound absorbing cover member 620 as in the sound absorbing device 600 illustrated in FIG. 1, a space may be generated at the joint between these members, due to the manufacture or assembly errors in the members. With a space at the joint, the cavities 601 cannot be completely sealed, so that the sound absorbing device 600 may fail to achieve the desired sound absorbing effect.

To address this issue, the sound absorbing cover member 620 may be provided with a recess at the joint of the sound absorbing cover member 620 and the sound absorbing body member 610, and a sealing member made of an elastic material may be placed in the recess. When the sealing member is provided in the recess, the sealing member is nipped and pressed between the two members when the sound absorbing cover member 620 and the sound absorbing body member 610 are joined, and becomes deformed along the surface of the sound absorbing cover member 620 and the sound absorbing body member 610 so that a space can be sealed.

However, merely by providing a sealing member in the recess, the shape of the cavities 601 may change or a space may be formed at the joint when the sound absorbing cover member 620 vibrates with respect to the sound absorbing body member 610, and the sound absorbing device 600 may fail to achieve the desired sound absorbing effect.

The sound absorbing device 600 illustrated in FIG. 1, therefore, has the cover fixing screws 640 for fixing the sound absorbing cover member 620 and the sound absorbing body member 610 while the sealing member is interposed between the sound absorbing cover member 620 and the sound absorbing body member 610, and is deformed from the original shape with no pressure applied.

By fixing the sound absorbing cover member 620 to the sound absorbing body member 610 with the cover fixing screws 640, a pressure is applied to the joint between the sound absorbing cover member 620 and the sound absorbing body member 610. The sealing member positioned in the recess, which is at the joint, becomes compressed, thereby filling the space between the sound absorbing cover member 620 and the sound absorbing body member 610. In this manner, the cavities 601 can be better sealed, and the sound absorbing effect is improved.

Because the sealing member made of an elastic material is compressed, thereby securing the sound absorbing cover member 620 with respect to the sound absorbing body member 610, vibrations of the sound absorbing cover member 620 with respect to the sound absorbing body member 610 can be reduced. Therefore, a higher sound absorbing effect can be achieved.

If any fixing member, such as the cover fixing screws 640, is inside the cavities 601, the function of the Helmholtz resonator will deteriorate. Because, in the sound absorbing device 600 illustrated in FIG. 1, the cover fixing screws 640 that are the fixing members are positioned outside of the cavities 601, the fixing members do not deteriorate the function of the Helmholtz resonator.

In the sound absorbing device 600 illustrated in FIG. 1, the sealing member is pressed against an end of the body side wall portion 611*a* to 611*c*, which is a portion of the sound absorbing body member 610 forming the cavities 601, and is deformed in a manner following the surface, and is brought into contact with the side surface of the body side wall portion 611*a* to 611*c*. In this manner, the sealing member seals the space between the body side wall portion 611*a* to 611*c* of the sound absorbing body member 610 and the recess on the sound absorbing cover member 620.

As a material for the sound absorbing cover member 620, the sound absorbing body member 610, and the sound absorbing cap member 630*a* to 630*c*, a resin material such as polycarbonate or acrylonitrile butadiene styrene (ABS) resin may be used, but it is not limited to these.

Characteristics of the sound absorbing device 600 according to the first embodiment will now be explained.

Among the three Helmholtz resonators 670 in the sound absorbing device 600, the second resonator 670*b* is designed to absorb the sound at a frequency with its sound volume increased by the installation of the first resonator 670*a*. The third resonator 670*c* is designed to absorb the sound at a frequency with its sound volume increased by the installation of the second resonator 670*b*. Specifically, the first resonator 670*a* is designed to absorb the sound at a frequency of 900 hertz, the second resonator 670*b* is designed to absorb the sound at a frequency of 850 hertz, and the third resonator 670*c* is designed to absorb the sound at a frequency of 800 hertz.

Figure 10:
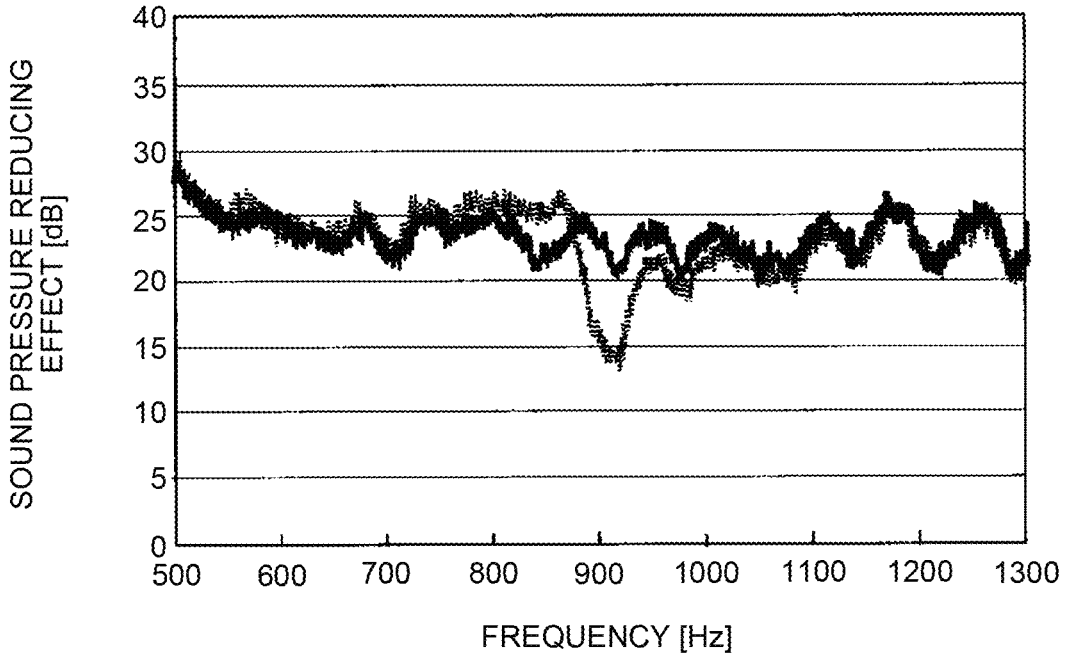
FIG. 10 is a graph illustrating the results of experiments conducted to confirm the sound absorbing effects with and without the sound absorbing device made only of a resin material.

FIG. 10 is a graph illustrating the results of experiments conducted to confirm the sound absorbing effects with and without the sound absorbing device 600 made only of a resin material and designed to absorb sound at 900 hertz. The results in the graph illustrated in FIG. 10 were measured by installing the sound absorbing device 600 in front of a speaker emitting sound across a wide range of frequencies, and installing a microphone serving as a measurement instrument opposite to the speaker, while the sound absorbing device 600 is positioned between the microphone and the speaker. The horizontal axis in FIG. 10 represents frequencies, and the vertical axis represents the measurements of sound volume (sound pressure) at each of the frequencies. The graph in a thick solid line in FIG. 10 represents the measurements with a lid placed over the communicating portion 603 of the sound absorbing device 600 so that the sound absorbing device 600 is not functioning as a Helmholtz resonator. The graph plotted in a dotted line in FIG. 10 represents the measurements without the lid placed over the communicating portion 603 of the sound absorbing device 600 so that the sound absorbing device 600 functions as a Helmholtz resonator absorbing sound at a frequency of 900 hertz.

In the graph illustrated in FIG. 10, while the volume of the sound near 900 hertz that is the absorbed sound frequency was reduced by the Helmholtz resonator, the sound at a frequency from 830 hertz to 870 hertz or so was increased, compared with that without the Helmholtz resonator. In other words, the sound absorbing device 600 that includes a Helmholtz resonator had a negative sound absorbing effect on the sound within a particular frequency range.

Through keen examination, the inventors of the present invention discovered that the Helmholtz resonator has exhibited a negative sound absorbing effect for the sound at frequencies about 50 hertz to 200 hertz below the absorbed sound frequency, that is, the Helmholtz resonator has increased the volume of the sound. Through keen examination, the inventors of the present invention also discovered that the frequencies of negatively affected sound tend to be dependent on the material used in the members used in the Helmholtz resonator. Specifically, a sound absorbing device 600 made only of a resin material, e.g., that according to the first embodiment, exhibited a negative sound absorbing effect for the sound at frequencies 30 hertz to 70 hertz below the absorbed sound frequency. Another sound absorbing device 600 including some metallic material, e.g., that according to a second embodiment of the present invention to be described later, exhibited a negative sound absorbing effect for the sound at frequencies 70 hertz to 200 hertz below the absorbed sound frequency.

Figure 11:
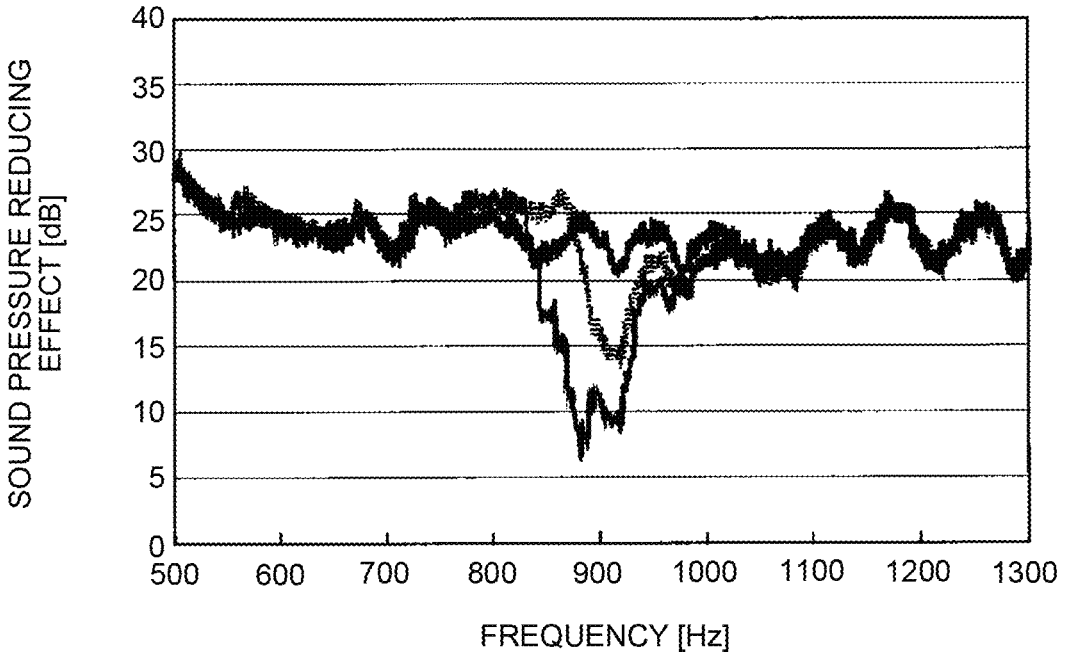
FIG. 11 is a graph in which the result of another experiment, conducted to confirm the sound absorbing effect with functioning Helmholtz resonators designed to absorb sound at a frequency of 900 hertz and a frequency of 850 hertz, is added to the graph illustrated in FIG. 10.

FIG. 11 is a graph in which the result of another experiment, conducted to confirm the sound absorbing effect with functioning Helmholtz resonators designed to absorb sound at a frequency of 900 hertz and a frequency of 850 hertz, is added, with a thin solid line, to the graph illustrated in FIG. 10. The graph in a thick solid line and the graph in a dotted line in FIG. 11 are the same as those in FIG. 10.

As illustrated in FIG. 11, this additional Helmholtz resonator designed to absorb the sound at a frequency of 850 hertz can suppress the volume of the sound at a frequency at which the Helmholtz resonator designed to absorb sound at a frequency of 900 hertz had exhibited a negative sound absorbing effect.

The sound absorbing device 600 according to the first embodiment is provided with the three Helmholtz resonators 670, and the Helmholtz resonators 670 are designed to absorb sound at a particular frequency interval (50 hertz). In this manner, the second resonator 670*b* can absorb the sound at a frequency negatively affected by the installation of the first resonator 670*a* absorbing the sound at the highest frequency, and the third resonator 670*c* can absorb the sound at a frequency negatively affected by the installation of the second resonator 670*b*. In this manner, the sound absorbing device 600 according to the first embodiment can absorb the sound at a frequency negatively affected by one Helmholtz resonator 670 in supplemental manner, and reduce the sound at frequencies outside of the frequency of the sound absorbed by the Helmholtz resonator 670.

When a sound absorbing device is only capable of absorbing one frequency, the sound absorbing effect across a wide range of frequencies remain rather low. Because the sound absorbing device 600 according to the first embodiment includes a plurality of Helmholtz resonators absorbing different frequencies, the sound absorbing device 600 can achieve the sound absorbing effect not only for the sound at a particular frequency, but also that across a wide range of frequencies. The sound absorbing device 600 according to the first embodiment is explained to have three Helmholtz resonators 670, but the number of Helmholtz resonators 670 may be two, four, or more, as long as one of the Helmholtz resonators 670 is configured to absorb the sound at a frequency negatively affected by another Helmholtz resonator 670.

Second Embodiment

The sound absorbing device 600 according to a second embodiment will now be explained.

Figure 12:
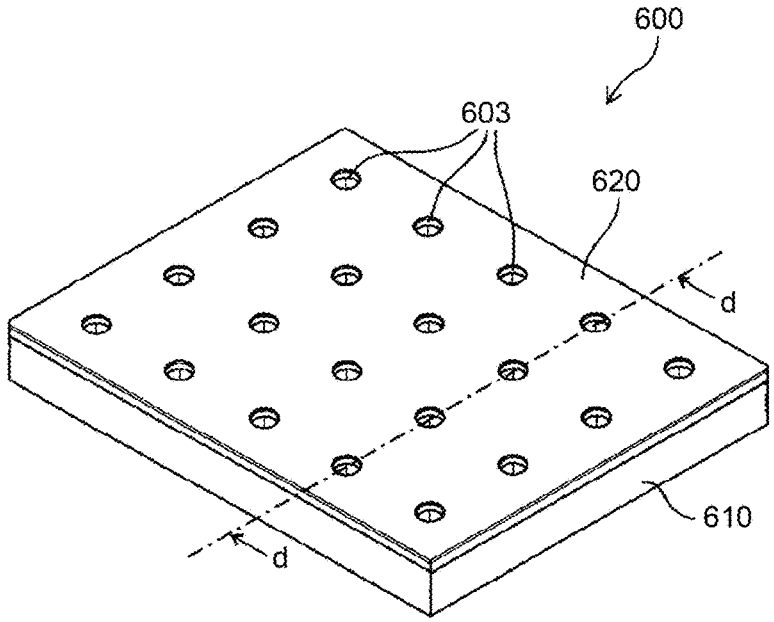
FIG. 12 is a perspective view for explaining a sound absorbing device according to a second embodiment of the present invention.
Figure 13:
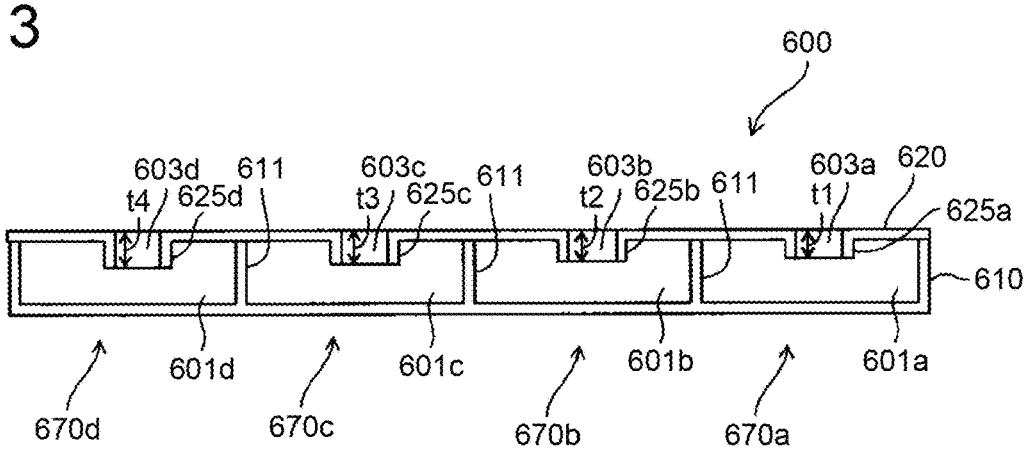
FIG. 13 is a schematic cross-sectional view of the sound absorbing device according to the second embodiment.

FIG. 12 is a perspective view for explaining the sound absorbing device 600 according to the second embodiment. FIG. 13 is a schematic cross-sectional view of the sound absorbing device 600 according to the second embodiment along the line d-d in FIG. 12. The sound absorbing device 600 according to the second embodiment includes two members, one of which is the sound absorbing body member 610 made of a resin material, and the other member is the sound absorbing cover member 620 made of a metallic material (sheet metal). The sound absorbing cover member 620 and the sound absorbing body member 610 that are provided as a pair together form a plurality of Helmholtz resonators 670 (four in the cross section illustrated in FIG. 13).

As illustrated in FIG. 13, the sound absorbing cover member 620 made from a sheet metal has a plurality of flanges 625*a* to 625*d* each making up a communicating portion 603*a* to 603*d*. The sound absorbing device 600 according to the second embodiment has the flanges 625*a* to 625*d* each of which is a standing portion provided in a manner standing along the communicating direction with respect to the sheet portion of the sound absorbing cover member 620, and in a manner standing toward the inside of the cavity 601*a* to 601*d*. The sound absorbing body member 610 made of a resin material has a plurality of body side wall portions 611*a* to 611*c* each of which serves as a partition that forms the cavity 601*a* to 601*d*. A pair of the communicating portion 603*a* to 603*d* and the cavity 601*a* to 601*d* makes up a Helmholtz resonator 670, and the shape of the Helmholtz resonator 670 determines the frequency of the sound absorbed by the Helmholtz resonator 670 (absorbed sound frequency).

In the sound absorbing device 600 according to the second embodiment, among the four Helmholtz resonators 670, the second resonator 670*b* is designed to absorb the sound at a frequency with its volume increased by the installation of the first resonator 670*a*. The third resonator 670*c* is designed to absorb the sound at a frequency with its volume increased by the installation of the second resonator 670*b*. The fourth resonator 670*d* is designed to absorb the sound at a frequency with its volume increased by the installation of the third resonator 670*c*. Specifically, the first resonator 670*a* is designed to absorb the sound at a frequency of 800 hertz, and the second resonator 670*b* is designed to absorb the sound at a frequency of 700 hertz. A third resonator 670*c* is designed to absorb the sound at a frequency of 600 hertz, and the fourth resonator 670*d* is designed to absorb the sound at a frequency of 500 hertz.

The flanges 625*a* to 625*d* are formed on the sound absorbing cover member 620 through the burring process, and the internal space of the flange 625*a* to 625*d* serves as the communicating portion 603*a* to 603*d* with an opening with the surface area S and the length H. The sound absorbing cover member 620 is closely bonded to the sound absorbing body member 610, through screwing or insertion molding, and the cavities 601*a* to 601*d* with the volume V is achieved with this bonding.

The burring process herein is a process of forming a rough hole on a sheet material, and pushing a punch with a diameter larger than that of the rough hole into the rough hole, thereby increasing the diameter of the rough hole and forming a flange around the opening. By forming the communicating portion 603*a* to 603*d* through the burring process, the communicating portion 603*a* to 603*d* with the opening 602 can be formed without the need for a separate member forming the communicating portion 603*a* to 603*d*, in addition to the sound absorbing cover member 620 making up a part of the wall forming the cavities 601*a* to 601*d*.

In the sound absorbing device 600 according to the second embodiment, the four Helmholtz resonators 670 are designed to absorb different frequencies by changing the burring height (t1, t2, t3, and t4 in FIG. 13). Because the different absorbed sound frequencies are achieved without changing the shape of the cavities 601*a* to 601*d*, a plurality of Helmholtz resonators 670 can be provided efficiently at an equal interval.

Figure 14:
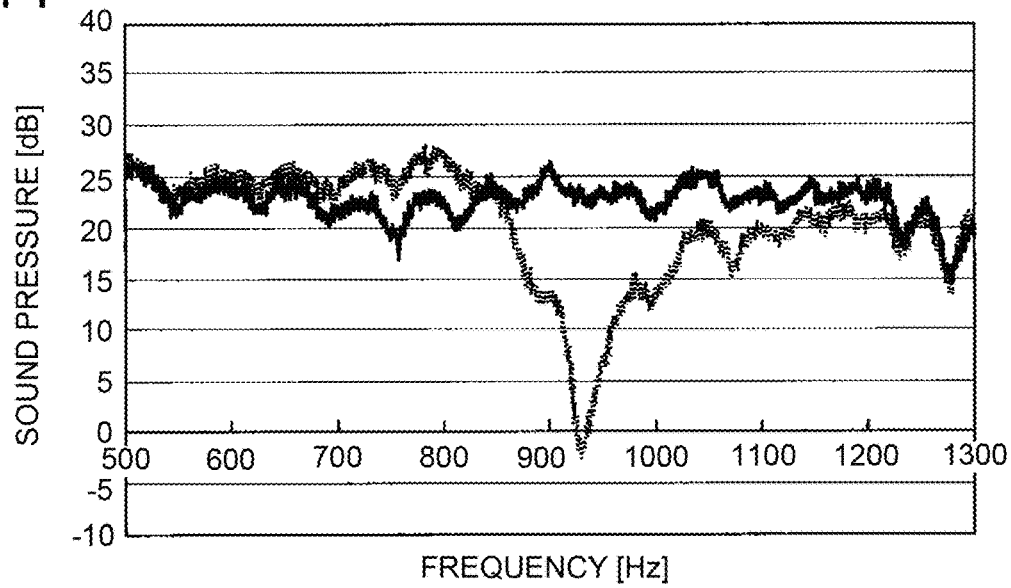
FIG. 14 is a graph illustrating the results of experiments conducted to confirm the sound absorbing effects with and without a sound absorbing device including a metallic material.

FIG. 14 is a graph illustrating the results of experiments conducted to confirm the sound absorbing effects with and without the sound absorbing device 600 including a sound absorbing cover member 620 made from a sheet metal and a sound absorbing body member 610 made of a resin material, and designed to absorb sound at 930 hertz. In the same manner as for the graph illustrated in FIG. 10, the results in the graph illustrated in FIG. 14 were measured by installing the sound absorbing device 600 in front of a speaker emitting sound across a wide range of frequencies, and installing a microphone serving as a measurement instrument opposite to the speaker, while the sound absorbing device 600 is positioned between the microphone and the speaker.

The horizontal axis in FIG. 14 represents the frequencies, and the vertical axis represents the measurements results of the sound volume (sound pressure) at each of the frequencies. The graph in a thick solid line in FIG. 14 represents the measurements with a lid placed on the communicating portion 603 of the sound absorbing device 600 so that the sound absorbing device 600 is not functioning as a Helmholtz resonator. The graph plotted in a dotted line in FIG. 14 represents the measurements without the lid placed on the communicating portion 603 of the sound absorbing device 600 so that the sound absorbing device 600 is functioning as a Helmholtz resonator absorbing sound at a frequency of 930 hertz.

In the graph illustrated in FIG. 14, the volume of the sound near 930 hertz that is the absorbed sound frequency was reduced by the Helmholtz resonator, but the sound at a frequency from 700 hertz to 830 hertz or so was increased to a level higher than that without the Helmholtz resonator. In other words, the sound absorbing device 600 that includes a Helmholtz resonator had a negative sound absorbing effect on the sound within a particular frequency range.

As illustrated in FIG. 14, with the sound absorbing cover member 620 made of a metallic material, in the manner explained in the second embodiment, the sound absorbing device 600 had a negative sound absorbing effect on the sound at frequencies about 70 hertz to 200 hertz below the absorbed sound frequency. To absorb the sound at frequencies at which the sound absorbing device 600 exhibited the negative absorbing effect, the sound absorbing device 600 according to the second embodiment has the four Helmholtz resonators 670, the cross sections of which are illustrated in FIG. 13, that are designed to absorb frequencies at a particular interval (100 hertz pitch).

In this manner, the second resonator 670*b* can absorb the sound at a frequency negatively affected by the installation of the first resonator 670*a* absorbing the highest frequency, and the third resonator 670*c* can absorb the sound at a frequency negatively affected by the installation of the second resonator 670*b*. Further, the fourth resonator 670*d* can absorb the sound at a frequency negatively affected by the installation of the third resonator 670*c*. In this manner, the sound absorbing device 600 according to the second embodiment can absorb the sound at a frequency negatively affected by one Helmholtz resonator 670 in supplemental manner, and reduce the sound at frequencies outside of that absorbed by the one Helmholtz resonator 670.

Exemplary resin materials used for the sound absorbing body member 610 in the sound absorbing device 600 according to the second embodiment include, but not limited to, polycarbonate and ABS resin. Exemplary sheet metals used for the sound absorbing cover member 620 in the sound absorbing device 600 according to the second embodiment include steel-sheet metal such as a zinc-coated steel sheet, but may be any sheet metal made of any other metals such as aluminum.

The sound absorbing device 600 according to the second embodiment may be attached to an outer cover such as the openable front cover 101 in the copier 500. To attach the sound absorbing device 600 to the outer cover, the sound absorbing body member 610, which is made of a resin material, may be formed integrally with the inner surface of the outer cover which is also made of a resin material, and the sound absorbing body member 610 formed on the outer cover may be fixed to the sound absorbing cover member 620. By providing the sound absorbing device 600 to the outer cover, the sound absorbing device 600 can absorb sound before leaking through the outer cover to the external. Furthermore, by integrally forming at least a part of the sound absorbing device 600 as a part of the outer cover, the number of parts can be reduced.

In the sound absorbing device 600 according to the first and the second embodiments, the second resonator 670*b* absorbing the sound at a frequency negatively affected by the installation of the first resonator 670*a* is positioned adjacent to the first resonator 670*a*, and the third resonator 670*c* and the fourth resonator 670*d* are positioned in the same manner. With this, the sound at a frequency negatively affected by the installation of one Helmholtz resonator can be absorbed by another Helmholtz resonator.

In the first and the second embodiments, the particular interval of the frequencies of the sound absorbed by a plurality of Helmholtz resonators is determined based on the material(s) used in the members making up the Helmholtz resonators. Specifically, the particular absorbed sound frequency interval is set to 50 hertz in the sound absorbing device 600 according to the first embodiment, which is made only of a resin material, and the particular absorbed sound frequency interval is set to 100 hertz in the sound absorbing device 600 according to the second embodiment, which also includes a metallic material. The particular interval between the absorbed sound frequencies of the Helmholtz resonators may be determined based on other factors, without limitation to the material(s) used in the members making up the Helmholtz resonators.

For example, the frequency interval may be determined in the manner described below. To begin with, an experiment is conducted to measure the frequency at which the sound volume increases with a Helmholtz resonator designed to absorb the sound at the most desirable frequency, among those of the sound emitted from a sound source. Another Helmholtz resonator is then designed to absorb the sound at a frequency with its volume increased in the measurement, and another experiment is conducted to measure the frequency of the sound with its sound volume increased when another Helmholtz resonator is used. In the manner described above, by actually conducting experiments to measure the frequency at which the sound volume increases with one Helmholtz resonator, another Helmholtz resonator absorbing the frequency may then be designed and combined with the one Helmholtz resonator.

The sound absorbing device 600 according to the first embodiment is positioned facing the laser writing device 47, as illustrated in FIG. 6, so that the sound absorbing device 600 can efficiently absorb the sound resulting from rotations of the polygon mirror 48 in the laser writing device 47, and the driving sound of the polygon motor 49. The sound absorbing device having the characterizing features of the embodiment, however, may be provided in any position in the image forming apparatus as appropriate, such as on the outer cover as explained in the second embodiment.

First Modification

A first modification of the sound absorbing device 600 will now be explained, as an exemplary sound absorbing device that can be provided with the characterizing features of the embodiment.

Figure 15A:
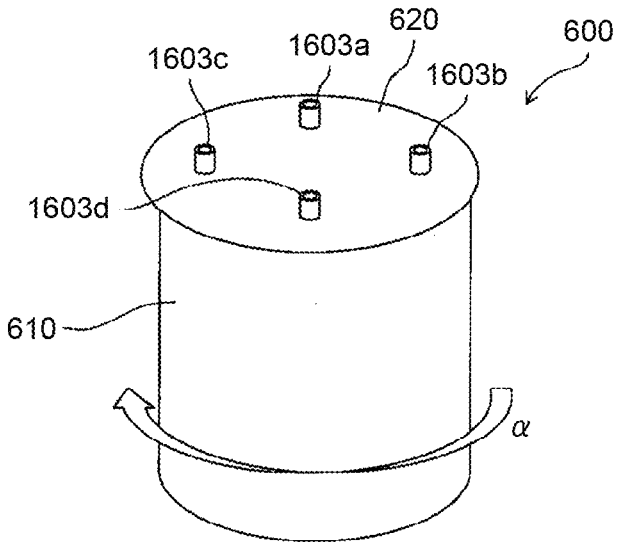
FIGS. 15A and 15B are schematic perspective views of the sound absorbing device according to the first modification.
Figure 15B:
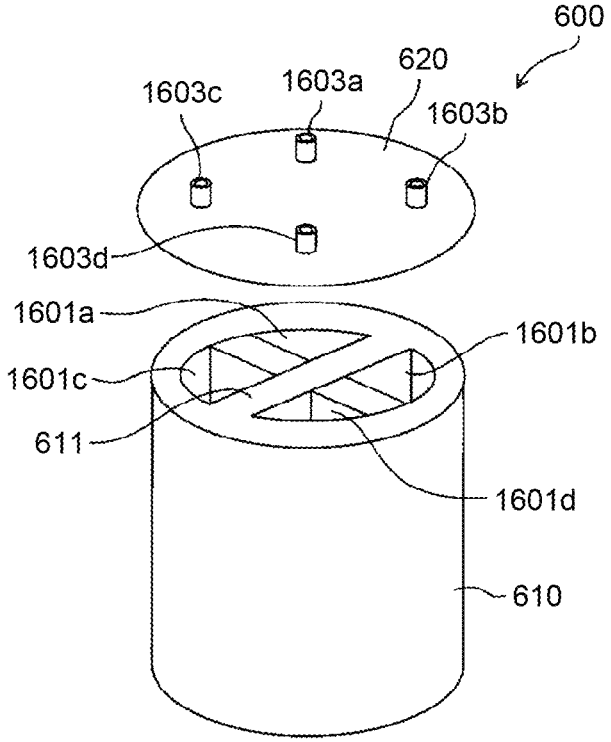

FIGS. 15A and 15B are schematic perspective views of the sound absorbing device 600 according to the first modification. FIG. 15A is a schematic for explaining the sound absorbing body member 610 assembled with the sound absorbing cover member 620, and FIG. 15B is a schematic for explaining the sound absorbing cover member 620 removed from the sound absorbing body member 610.

As illustrated in FIGS. 15A and 15B, the sound absorbing device 600 according to the first modification is a cylindrical sound absorbing device that includes Helmholtz resonators.

The sound absorbing cover member 620 is one of the walls that form the cavities 601 of the respective Helmholtz resonators, the one being the wall provided with the communicating portions 603 that communicate with the external. The sound absorbing cover member 620 is provided with a plurality of (four) necks 1603*a* to 1603*f* (1603*a* to 1603*fa* to 1603*a* to 1603*fd*) each of which forms a hole that serves as the communicating portion 603.

The sound absorbing body member 610 provides body side wall portions 611*a* to 611*c* as the walls for forming the cavities 601 other than the wall provided with the communicating portions 603. The sound absorbing body member 610 is also provided with a plurality of (four) opened spaces 1601*a* to 1601*f* each of which serves as the cavity 601 by being surrounded by the body side wall portion 611*a* to 611*c* and having its opening closed by the sound absorbing cover member 620.

In the sound absorbing device 600 according to the first modification, one of the Helmholtz resonators 670 is formed by assemblage of the sound absorbing cover member 620 and the sound absorbing body member 610, assembled in such a manner that each of the necks 1603*a* to 1603*f* faces corresponding one of the opened spaces 1601*a* to 1601*f*. In the first modification, four Helmholtz resonators 670 are formed by assemblage of the sound absorbing cover member 620 and the sound absorbing body member 610, assembled in such a manner that each of the four necks 1603*a* to 1603*f* (1603*a* to 1603*fa* to 1603*a* to 1603*fd*) faces corresponding one of the four opened spaces 1601*a* to 1601*f*.

The surface area of the hole opening formed with the neck 1603*a* to 1603*f* corresponds to the surface area of the opening of the communicating portion 603 once assembled, and corresponds to "S" in Equation (1) mentioned above. The length of the hole formed with the neck 1603*a* to 1603*f* corresponds to the length of the communicating portion 603 once assembled, and corresponds to "H" in Equation (1) mentioned above. The volume of the opened space 1601*a* to 1601*f* corresponds to the volume of the cavity 601 once assembled, and corresponds to "V" in Equation (1) mentioned above.

From Equation (1), these three parameters, excluding the speed of sound "c", determine the absorbed sound frequency (resonance frequency) of the Helmholtz resonator 670.

In the first modification, either one or both of the parameters related to the neck 1603*a* to 1603*f* ("S" or "H" mentioned above) and the parameters related to the opened space 1601*a* to 1601*f* ("V" mentioned above) are designed to be different. The parameters of the neck 1603*a* to 1603*f* being different means that one of the four necks 1603*a* to 1603*f* is different from at least one of the other three necks 1603*a* to 1603*f* in at least one parameter among the two parameters related to the opening surface area ("S" mentioned above) and the hole length ("H" mentioned above). The parameters related to the opened space 1601*a* to 1601*f* being different means that one of the four opened spaces 1601*a* to 1601*f* is different from the at least one of the other three opened spaces 1601*a* to 1601*f* in the volume parameter ("V" mentioned above).

As indicated by arrow α in FIG. 15A, by rotating the sound absorbing body member 610 with the opened spaces 1601*a* to 1601*f* with respect to the sound absorbing cover member 620 with the necks 1603*a* to 1603*f*, the pairing between one neck 1603*a* to 1603*f* and the corresponding opened space 1601*a* to 1601*f* facing each other is changed. In this manner, the absorbed sound frequency of a Helmholtz resonator formed by the neck 1603*a* to 1603*f* can be changed.

In the example illustrated in FIGS. 15A and 15B, the sound absorbing body member 610 is rotated with respect to the sound absorbing cover member 620, but the sound absorbing cover member 620 may be rotated with respect to the sound absorbing body member 610.

Table 1 indicates an example in which how the absorbed sound frequencies are changed when the pairing between each of the necks 1603*a* to 1603*f* and corresponding one of the opened spaces 1601*a* to 1601*f* is changed, in the structure similar to the sound absorbing device 600 according to the first modification, but with seven necks 1603*a* to 1603*f* and seven opened spaces 1601*a* to 1601*f*.

TABLE 1

| Opened Space | Volume of Opened Space | Neck Type | | Neck Hole Diameter [mm] | | Neck Hole Length | Resonance Frequency [Hz] | |
|---|---|---|---|---|---|---|---|---|
| Type | [mm³] | Pattern 1 | Pattern 2 | Pattern 1 | Pattern 2 | [mm] | Pattern 1 | Pattern 2 |
| (1) | 8000 | (a) | (g) | 10 | 7 | 2 | 3794 | 2656 |
| (2) | 16000 | (b) | (a) | 9 | 10 | 2 | 2415 | 2683 |
| (3) | 8000 | (c) | (b) | 4 | 9 | 2 | 1518 | 3415 |
| (4) | 16000 | (d) | (c) | 6 | 4 | 2 | 1610 | 1073 |

TABLE 1-continued

| Opened Space | Volume of Opened Space | Neck Type | | Neck Hole Diameter [mm] | | Neck Hole Length | Resonance Frequency [Hz] | |
|---|---|---|---|---|---|---|---|---|
| Type | [mm$^3$] | Pattern 1 | Pattern 2 | Pattern 1 | Pattern 2 | [mm] | Pattern 1 | Pattern 2 |
| (5) | 8000 | (e) | (d) | 5 | 6 | 2 | 1897 | 2277 |
| (6) | 16000 | (f) | (e) | 8 | 5 | 2 | 2146 | 1342 |
| (7) | 8000 | (g) | (f) | 7 | 8 | 2 | 2656 | 3035 |

In Table 1, the opened spaces 1601*a* to 1601*f* are numbered (1) to (7), and the necks 1603*a* to 1603*f* are numbered (a) to (g). The exemplary sound absorbing body member 610 indicated in Table 1 has four opened spaces 1601*a* to 1601*f* with a volume of 8000 [mm$^3$] and three opened spaces 1601*a* to 1601*f* with a volume of 16000 [mm$^3$], and these seven opened spaces 1601*a* to 1601*f* are circumferentially arranged. The sound absorbing cover member 620 indicated in Table 1 is provided with seven necks 1603*a* to 1603*f* all of which have a hole with a length of 2 [mm], and these seven necks 1603*a* to 1603*f* are circumferentially arranged.

In the state of Pattern 1, the opened space 1601*a* to 1601*f* of (1) faces the neck 1603*a* to 1603*f* of (a), and the opened spaces 1601*a* to 1601*f* of (2) to (7) face the necks 1603*a* to 1603*f* of (b) to (g), respectively, in the same manner. The sound absorbing body member 610 or the sound absorbing cover member 620 is rotated from the state of Pattern 1 to the state of Pattern 2 in which the opened space 1601*a* to 1601*f* of (1) faces the neck 1603*a* to 1603*f* of (g).

Figure 16:
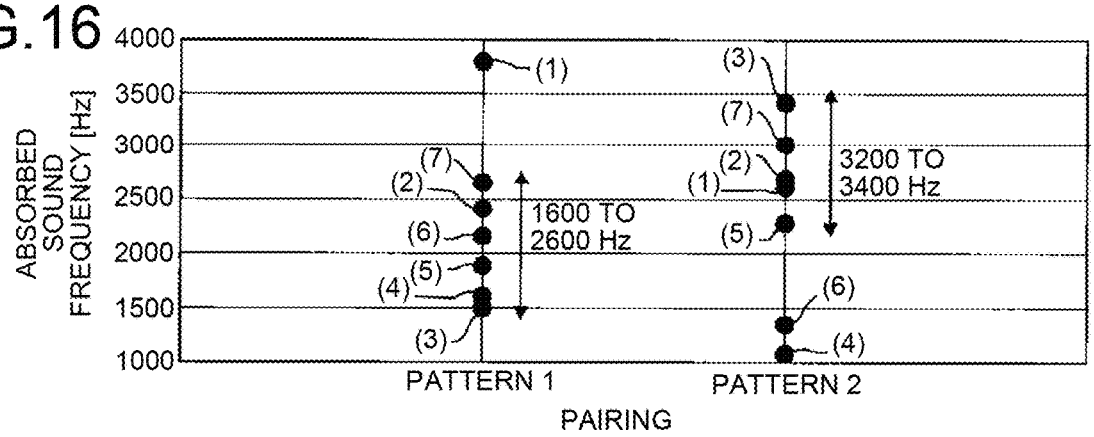
FIG. 16 is a graph plotting calculation results of the frequencies of the sound absorbed by seven respective Helmholtz resonators in the states of Pattern 1 and Pattern 2.

FIG. 16 is a graph plotting calculation results of the frequencies of the sound absorbed by the seven Helmholtz resonators 670 formed by the opened spaces 1601*a* to 1601*f* of (1) to (7) in each of Pattern 1 and Pattern 2.

As illustrated in FIG. 16, in Pattern 1 and Pattern 2, the absorbed sound frequencies of the Helmholtz resonators 670 fall within different ranges of frequencies. The sound absorbing device 600 in Pattern 1 has a high absorbing effect in a frequency range of 1500 hertz to 2600 hertz, and the sound absorbing device 600 in Pattern 2 has a high absorbing effect in a frequency range of 2300 hertz to 3400 hertz.

Because a conventional Helmholtz resonator is only capable of absorbing the sound at one frequency, the frequency of the sound to be absorbed by the Helmholtz resonator (the absorbed sound frequency) can only be changed by changing one of the surface area of the opening of the communicating portion 603, the length of the communicating portion 603, and the volume of the cavity 601 that determine the absorbed sound frequency. To change these dimensional factors, it has been necessary to change the shape of the members making up the Helmholtz resonator, and to make such a change by replacing the members making up the Helmholtz resonator.

In the sound absorbing device 600 according to the first modification, the plurality of opened spaces 1601*a* to 1601*f* and the plurality of necks 1603*a* to 1603*f* capable of forming a Helmholtz resonator 670 are prepared, and a plurality of parameters are prepared for both of the plurality of opened spaces 1601*a* to 1601*f* and the plurality of necks 1603*a* to 1603*f*. By switching the opened space 1601*a* to 1601*f* to be paired with the corresponding neck 1603*a* to 1603*f*, the absorbed sound frequency of the Helmholtz resonators 670 formed in the sound absorbing device 600 can be changed without replacing the members making up the Helmholtz resonator 670.

Furthermore, in the sound absorbing device 600 according to the first modification, a plurality of absorbed sound frequencies of the Helmholtz resonator 670 can be changed at once.

Figure 17:
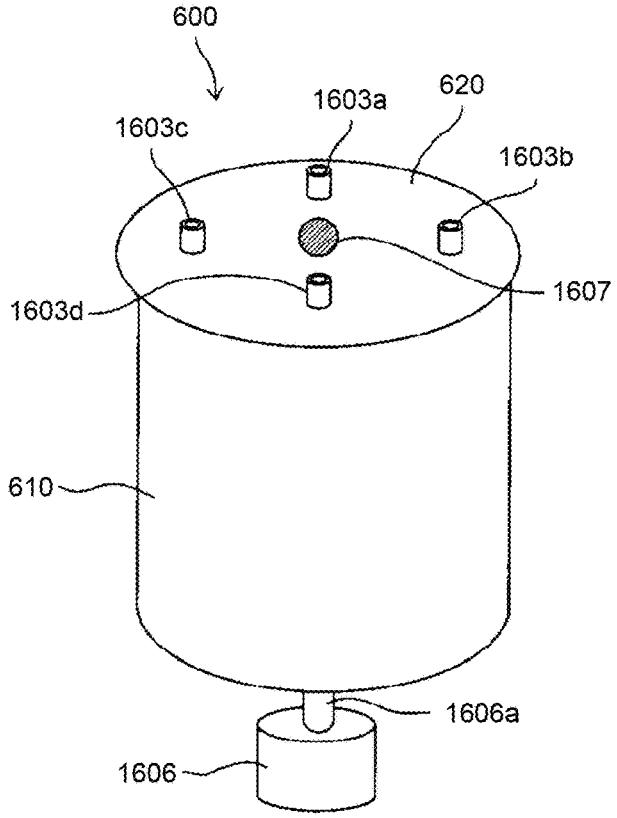
FIG. 17 is a schematic for explaining structure capable of automatically changing the absorbed sound frequencies.

FIG. 17 is a schematic for explaining the structure capable of automatically changing the absorbed sound frequencies, achieved by adding a microphone 1607 that is a sound detecting unit and a sound absorbing body member rotating motor 1606 that is a cavity forming member moving unit for moving the sound absorbing body member 610 to the sound absorbing device 600 according to the first modification. The sound absorbing body member rotating motor 1606 is a driving source that moves the sound absorbing body member 610 with respect to the sound absorbing cover member 620 by moving the sound absorbing body member 610 circumferentially about a rotational shaft 1606*a*.

Figure 18:
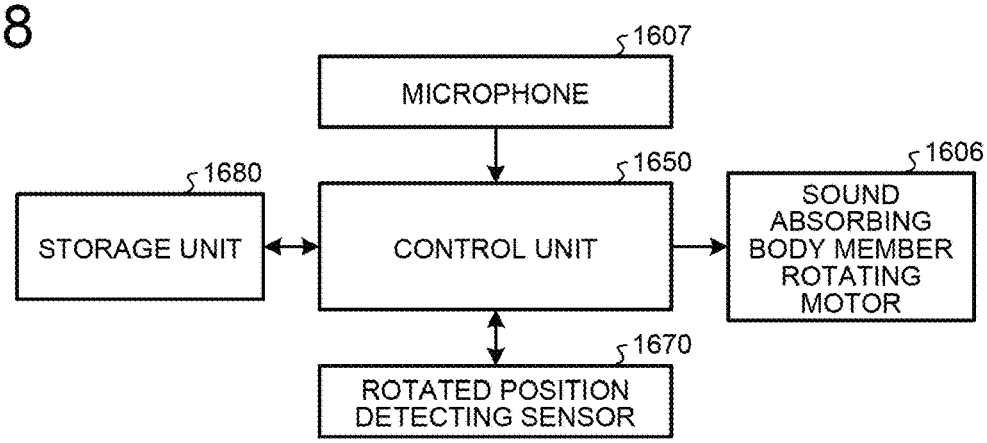
FIG. 18 is a block diagram illustrating a control system of a sound absorbing body member rotating motor included in the sound absorbing device illustrated in FIG. 17.

FIG. 18 is a block diagram illustrating a control system of the sound absorbing body member rotating motor 1606 included in the sound absorbing device 600 illustrated in FIG. 17.

A control unit 1650 that is a cavity forming member movement control unit controls the sound absorbing body member rotating motor 1606 to change the position of the sound absorbing body member 610 with respect to the sound absorbing cover member 620, based on a detection result of the microphone 1607.

The sound absorbing device 600 illustrated in FIG. 17 also includes a rotated position detecting sensor 1670 for detecting the position of the sound absorbing body member 610 with respect to the sound absorbing cover member 620 in the rotating direction. In the sound absorbing device 600 illustrated in FIG. 17, four Helmholtz resonators 670 are formed by four pairs of the opened space 1601*a* to 1601*f* and the neck 1603*a* to 1603*f*. There are therefore four possible positional relations of the sound absorbing cover member 620 and the sound absorbing body member 610 at which an opened space 1601*a* to 1601*f* faces the corresponding neck 1603*a* to 1603*f*. The frequencies of the sound absorbed by the respective four Helmholtz resonators 670 in each of these four possible positional relations are stored in a storage unit 1680 in advance. The control unit 1650 then calculates a positional relation between the sound absorbing cover member 620 and the sound absorbing body member 610 that can form the four Helmholtz resonators 670 that are most capable of absorbing the sound detected by the microphone 1607. The control unit 1650 then compares the calculated positional relation with the positional relation detected by the rotated position detecting sensor 1670, and moves the sound absorbing body member 610 circumferentially to achieve the calculated positional relation, by driving the sound absorbing body member rotating motor 1606.

With such structure, the microphone 1607 collects the sound generated around the sound absorbing device 600, and detects a frequency of sound of a particularly large volume, from the candidate frequencies to be absorbed by the sound absorbing device 600. The Helmholtz resonators can then be automatically optimized to absorb the sound at a frequency nearest to the frequency intended to be absorbed, by causing the sound absorbing body member rotating motor 1606 to rotate the sound absorbing body member 610 in a manner suitable for the detection result.

In a configuration in which the sound absorbing body member 610 is rotated, the sound absorbing cover member 620 having the necks 1603*a* to 1603*f* is fixed to another member (an internal stay, in the example of an image forming apparatus). The member moved by the cavity forming member moving unit is not limited to the sound absorbing body member 610 that forms the opened space 1601, but may be the sound absorbing cover member 620 having the necks 1603*a* to 1603*f*. In this case, the sound absorbing body member 610 is fixed to the apparatus.

Second Modification

A second modification of the sound absorbing device 600 will now be explained, as an exemplary sound absorbing device that can be provided with the characterizing features of the embodiment.

Figure 19A:
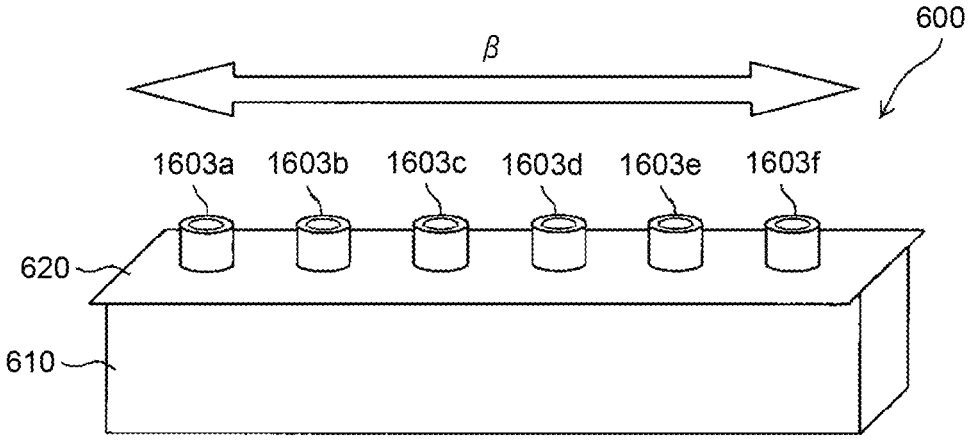
FIGS. 19A and 19B are schematic perspective views of the sound absorbing device according to a second modification.
Figure 19B:
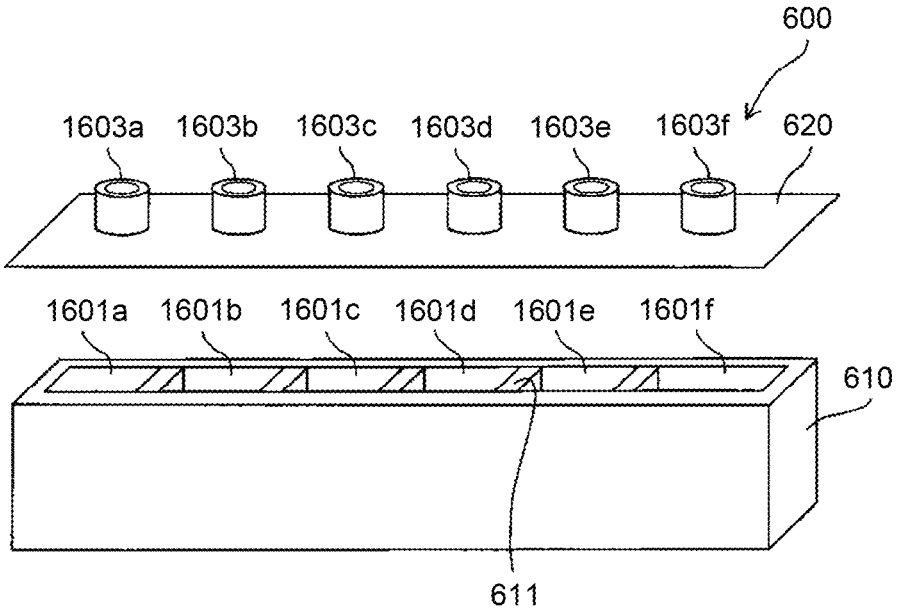

FIGS. 19A and 19B are schematic perspective views of the sound absorbing device 600 according to the second modification. FIG. 19A is a schematic for explaining the sound absorbing body member 610 assembled with the sound absorbing cover member 620, and FIG. 19B is a schematic for explaining the sound absorbing cover member 620 removed from the sound absorbing body member 610.

As illustrated in FIGS. 19A and 19B, the sound absorbing device 600 according to the second modification is a sound absorbing device including a plurality of Helmholtz resonators that are linearly arranged. The sound absorbing device 600 according to the second modification has the structure in which the frequencies of the sound absorbed by the Helmholtz resonators 670 are changed by sliding one of the sound absorbing cover member 620 and the sound absorbing body member 610 with respect to the other.

The sound absorbing cover member 620 forms one of the walls that form the cavities 601 of the respective Helmholtz resonators, the one being the wall provided with the communicating portions 603 that communicate with the external. The sound absorbing cover member 620 has a plurality of (six) necks 1603*a* to 1603*f* (1603*a* to 1603*fa* to 1603*a* to 1603*ff*) each of which forms a hole serving as the communicating portion 603.

The sound absorbing body member 610 has body side wall portions 611*a* to 611*c* providing walls for forming the cavities 601, except for the wall having the communicating portions 603. A plurality of (six) opened spaces 1601*a* to 1601*f* serving as the cavities 601 are formed inside the sound absorbing body member 610. Each of the opened spaces 1601*a* to 1601*f* is formed by being surrounded by a body side wall portion 611*a* to 611*c*, and having its opening closed by the sound absorbing cover member 620.

In the sound absorbing device 600 according to the second modification, one of the Helmholtz resonators 670 is formed by assemblage of the sound absorbing cover member 620 and the sound absorbing body member 610, assembled in such a manner that a neck 1603*a* to 1603*f* faces the corresponding opened space 1601, similarly to the first modification. In the second modification, six Helmholtz resonators 670 are formed by assemblage of the sound absorbing cover member 620 and the sound absorbing body member 610, assembled in such a manner that each of the six necks 1603*a* to 1603*f* (1603*a* to 1603*fa* to 1603*a* to 1603*ff*) faces corresponding one of the six opened spaces 1601*a* to 1601*f*, as illustrated in FIG. 19A.

In the second modification, one of the six necks 1603*a* to 1603*f* has at least one different parameter, among the two parameters of the opening surface area ("S" mentioned above) and the hole length ("H" mentioned above), from at least one of the other five necks 1603*a* to 1603*f*. In the second modification, one of the six opened spaces 1601*a* to 1601*f* has a different volume parameter ("V" mentioned above) from that of at least one of the other five opened spaces 1601*a* to 1601*f*.

In the sound absorbing device 600 according to the second modification, one of the sound absorbing cover member 620 provided with the necks 1603*a* to 1603*f* and the sound absorbing body member 610 forming the opened spaces 1601*a* to 1601*f* is slid in the direction of the arrow β in FIGS. 19A and 19B with respect to the other. In this manner, the absorbed sound frequency of one of the Helmholtz resonators formed by the corresponding neck 1603*a* to 1603*f* can be changed, similarly to the sound absorbing device 600 according to the first modification.

In the second modification, by changing the neck 1603*a* to 1603*f* to be paired with the corresponding opened space 1601*a* to 1601*f* by sliding one of the sound absorbing cover member 620 and the sound absorbing body member 610 with respect to the other, the frequencies of the sound absorbed by the sound absorbing device 600 can be changed.

In the structure in which one of the sound absorbing cover member 620 and the sound absorbing body member 610 is slid, as disclosed in the second modification, a driving source causing one of these members to reciprocate linearly may be provided. With such a driving source, the Helmholtz resonators can be automatically optimized to absorb the sound at the frequency nearest to the frequency of the sound intended to be absorbed, similarly to the sound absorbing device 600 illustrated in FIG. 17.

In the sound absorbing device 600 according to the first and the second modifications, one of the sound absorbing cover member 620 and the sound absorbing body member 610 may be a magnet, and the other may be a ferromagnetic body. Because the sound absorbing device 600 according to the first and the second modifications has a configuration in which one of the sound absorbing cover member 620 and the sound absorbing body member 610 is moved with respect to the other, the sound absorbing cover member 620 and the sound absorbing body member 610 cannot be fixed together using screws or the like. A space may then be generated at the joint between the sound absorbing cover member 620 and the sound absorbing body member 610 that are not fixed to each other, and the sound absorbing device 600 may fail to achieve the desired absorbing effect. When one of the sound absorbing cover member 620 and the sound absorbing body member 610 is a magnet and the other is a ferromagnetic body, these members attract each other even in a configuration in which these two members are relatively movable. The joint can therefore be better sealed.

The frequency of the sound absorbed by a Helmholtz resonator 670 changes when the length of the communicating portion 603 or the surface area of the opening is changed. By additionally changing the volume of the cavity 601, the absorbed sound frequency can be changed again. By using a configuration in which pairing of the neck 1603*a* to 1603*f* that forms a hole to serve as the communicating portion 603 and the opened space 1601*a* to 1601*f* that is to serve as the cavity 601, the absorbed sound frequency can be changed without changing the shape of the members making up the Helmholtz resonators 670.

In the sound absorbing device 600 according to the first and the second modifications as well, at least one of the Helmholtz resonators may be designed to absorb the sound at a frequency with its sound volume increased by the installation of another Helmholtz resonator. Such a configuration enables the absorbed sound frequencies to be changed easily, and can suppress a volume increase of the sound at frequencies outside the frequency of the sound absorbed by one Helmholtz resonator.

Figure 20:
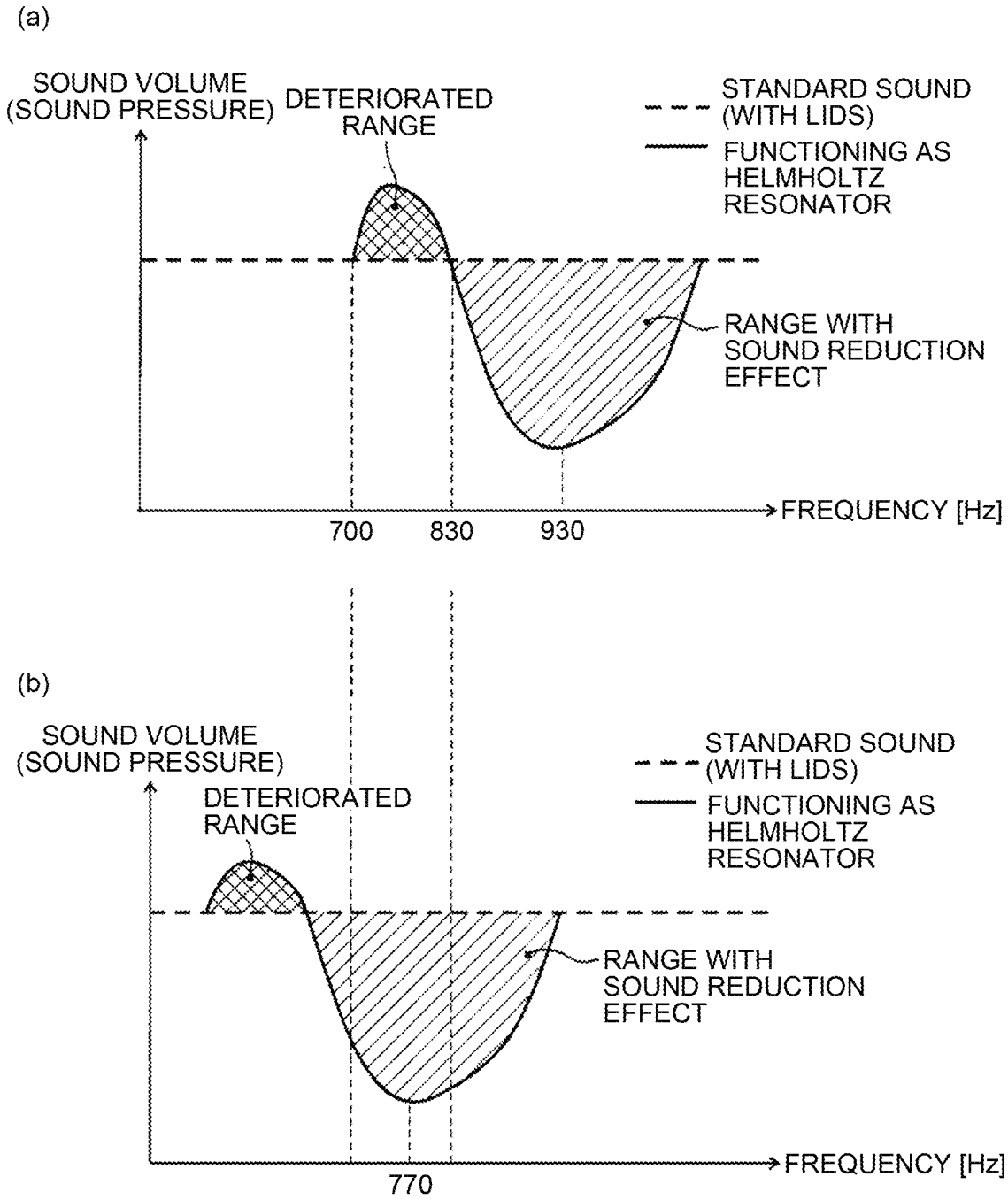
FIG. 20 is a graph schematically illustrating the sound absorbing effects of two Helmholtz resonators absorbing the sound of different frequencies; a graph achieved when the absorbed sound frequency is set to 930 hertz is illustrated at (a); and a graph achieved when the absorbed sound frequency is set to 770 hertz is illustrated at (b).

FIG. 20 is a graph schematically illustrating the sound absorbing effects of two Helmholtz resonators absorbing different frequencies. A graph achieved by a Helmholtz resonator with the absorbed sound frequency set to 930 hertz is illustrated at (a). A graph achieved by a Helmholtz resonator with the absorbed sound frequency set to 770 hertz is illustrated at (b).

In FIG. 20, although indicated as a dotted line for the purpose of convenience is a standard sound representing the sound achieved with the openings (communicating portions 603) of the sound absorbing units closed with respective lids and without the sound absorbing units functioning as Helmholtz resonators, the actual standard sound has varying sound pressure depending on the frequency, as illustrated in FIG. 10.

In FIG. 20, a solid curved line represents the sound measured with the lids removed from the respective openings of the sound absorbing units and with the sound absorbing units functioning as Helmholtz resonators. The sound measured with the sound absorbing units functioning as Helmholtz resonators also has varying sound pressure depending on the frequency, as illustrated in FIG. 10. FIG. 20 gives a schematic representation to facilitate easy understanding of the difference between the volume (sound pressure) of the standard sound and that of the sound measured with the sound absorbing units functioning as Helmholtz resonators. The hatched area in FIG. 20 is a range where the volume reduction effect is achieved by the sound absorbing units functioning as Helmholtz resonators, and the gridded area in FIG. 20 is a range where the sound reduction effect deteriorated because the volume was increased by the sound absorbing units functioning as Helmholtz resonators.

A sound absorbing unit using a Helmholtz resonator can be designed to absorb sound at a frequency of 930 hertz by determining "S", "V", and "H" in Equation (1) mentioned above. However, in the example indicated at (a) in FIG. 20, while the frequency of near 930 hertz was effectively absorbed compared with the standard sound (without the sound absorbing units), the volume of the sound within a frequency range from 700 hertz to 830 hertz was increased.

Therefore, in such a manner as in the sound absorbing device 600 according to the embodiment described above, in the structure including a plurality of sound absorbing units using Helmholtz resonators, the sound absorbing unit achieving the sound absorbing effect indicated at (b) in FIG. 20 is provided together with (not necessarily adjacent to) the sound absorbing unit achieving the sound absorbing effect indicated at (a) in FIG. 20. By providing a sound absorbing unit with an absorbed sound frequency of 770 hertz, as indicated at (b) in FIG. 20, the sound absorbing unit can absorb the sound increased by the installation of the sound absorbing unit with an absorbed sound frequency of 930 hertz, which is indicated at (a) in FIG. 20.

As indicated at (b) in FIG. 20, the sound with its volume increased (the sound at frequencies from 500 hertz to 600 hertz) by the installation of the sound absorbing unit using a Helmholtz resonator with an absorbed sound frequency of 770 hertz may be absorbed by another sound absorbing unit absorbing the sound in this frequency range.

If the sound source does not generate any sound within a frequency range of 500 hertz to 600 hertz, it is not necessary to provide such an additional sound absorbing unit.

Explained now is a process of checking whether a sound absorbing device including a plurality of sound absorbing units using Helmholtz resonators has characterizing features of the sound absorbing device 600 according to the embodiment.

(1) Cause a speaker or the like to emit sound across a wide range of frequencies (white noise).

(2) Acquire "data 1" by placing lids on all of the openings of the sound absorbing units provided to the sound absorbing device, and by measuring the resultant sound.

(3) Acquire "data 2" by removing the lid from one of the openings of the sound absorbing units provided to the sound absorbing device, and by measuring the resultant sound.

(4) Based on the difference between the "data 1" and "data 2", acquire information of the sound absorbing effect of the sound absorbing unit with the lid removed, such as that indicated by the graph of FIG. 20.

Acquire the information of the sound absorbing effect of each one of the sound absorbing units using Helmholtz resonators provided to the sound absorbing device. If the "deteriorated range" of one of the sound absorbing units overlaps with the "range with sound reduction effect" of another sound absorbing unit, the sound absorbing devices can be said to be sound absorbing devices with the characterizing features of the sound absorbing device 600 according to the embodiment.

Explained in this embodiment is an example in which the electronic device provided with the sound absorbing device is an image forming apparatus, but the characterizing features of the embodiment may be provided to any electronic device other than the image forming apparatus, as long as such an electronic device has some sound source that generates sound during the operation, and a sound absorbing device that absorbs the sound generated by the sound source.

Explained above are merely exemplary, and the present invention achieves advantageous effects that are unique for each of the following aspects.

Aspect A

In a sound absorbing device such as the sound absorbing device 600 including a plurality of sound absorbing units such as the first resonator 670*a*, the second resonator 670*b*, and the third resonator 670*c*, the frequency of sound absorbed by at least one of the sound absorbing units such as the second resonator 670*b* overlaps, at least partially, with the frequency of the sound with its volume increased by the installation of another sound absorbing unit such as the first resonator 670*a*.

According to this, the sound at a frequency with its volume increased by the installation of one sound absorbing unit can be absorbed by another sound absorbing unit, as explained in the embodiments described above. In this manner, a volume increase of the sound at frequencies outside the frequency of the sound absorbed by the one sound absorbing unit can be suppressed.

Aspect B

In the sound absorbing device according to aspect A, the respective sound absorbing units are structured as Helmholtz resonators such as the Helmholtz resonators 670.

According to this, the sound at a frequency with its volume increased by the installation of one Helmholtz resonator can be absorbed by another Helmholtz resonator, as explained in the embodiments described above. In this manner, a volume increase of the sound at frequencies outside the frequency of the sound absorbed by the one Helmholtz resonator can be suppressed.

Aspect C

In the sound absorbing device according to aspect B, the members making up the Helmholtz resonators such as the Helmholtz resonators 670 are made of a resin material, and the interval between the frequency of the sound absorbed by one of the Helmholtz resonators such as the first resonator 670*a* and the frequency of the sound absorbed by another Helmholtz resonator such as the second resonator 670*b* is 30 hertz to 70 hertz.

According to this, the sound at a frequency with its volume increased by the installation of one Helmholtz resonator can be absorbed by the other Helmholtz resonator in the sound absorbing device made only of a resin material, as explained above in the first embodiment.

Aspect D

In the sound absorbing device according to aspect B, the members making up the Helmholtz resonators such as the Helmholtz resonators 670 include a member made of a metallic material such as a sheet metal, and the interval between the frequency of the sound absorbed by one of the Helmholtz resonators such as the first resonator 670*a* and the frequency of the sound absorbed by another Helmholtz resonator such as the second resonator 670*b* is 70 hertz to 200 hertz.

According to this, the sound at a frequency with its volume increased by the installation of one Helmholtz resonator can be absorbed by the other Helmholtz resonator in a sound absorbing device that includes a metallic material, as explained above in the second embodiment.

Aspect E

The sound absorbing device according to aspect D includes a first member such as the sound absorbing cover member 620 that forms a wall defining cavities such as the cavities 601 of the respective Helmholtz resonators 670, the wall being provided with communicating portions such as the communicating portions 603 communicating to the external, and a second member such as the sound absorbing body member 610 forming another wall defining the cavities. The first member is made of a metallic material such as a sheet metal, and the communicating portions are formed by performing the burring process on the metallic material.

According to this, the communicating portions can be formed without preparing a member for forming the communicating portions separately to the first member that forms a part of the wall defining the cavities, as explained in the embodiments described above.

Aspect F

In the sound absorbing device according to any one of aspects B to E, one of the Helmholtz resonators such as the first resonator 670*a* is positioned adjacent to another Helmholtz resonator such as the second resonator 670*b*.

According to this, the sound at a frequency negatively affected by one Helmholtz resonator can be easily absorbed by another Helmholtz resonator, as explained in the embodiments described above.

Aspect G

In the sound absorbing device according to any one of aspects B to F, frequencies of sound absorbed by the Helmholtz resonators such as the first resonator 670*a*, the second resonator 670*b*, and the third resonator 670*c* are differentiated by differentiating lengths of the communicating portions such as the communicating portions 603 that communicate to the external and are provided on a wall defining the cavities such as the cavities 601 of the respective Helmholtz resonators such as the Helmholtz resonators 670.

According to this, the absorbed sound frequencies can be differentiated without changing the shape of the cavities, so that a plurality of Helmholtz resonators can be arranged efficiently at an equal interval, as explained in the embodiments described above.

Aspect H

In the sound absorbing device according to any one of aspects B to G, the frequency of the sound absorbed by at least one of the respective Helmholtz resonators such as the first resonator 670*a*, the second resonator 670*b*, and the third resonator 670*c* is within a range of equal to or higher than 100 hertz and equal to or lower than 1500 hertz.

According to this, the leakage of sound at a frequency not sufficiently suppressed solely with a shielding member such as the outer cover can be suppressed, as explained in the embodiments described above.

Aspect I

The sound absorbing device according to any one of aspects B to H includes a first member such as the sound absorbing cover member 620 that forms a wall defining the cavities of the respective Helmholtz resonators, the wall being provided with the communicating portions communicating to the external, and a second member such as the sound absorbing body member 610 that forms another wall defining the cavities. The first member is provided with a plurality of holes such as holes in the respective necks 1603*a* to 1603*f* each of which serves as one of the communicating portions. The second member is provided with a plurality of opened spaces such as the opened spaces 1601*a* to 1601*f* each of which serves as one of the cavities by being surrounded by another wall and by having its opening closed by the first member. The Helmholtz resonators are formed by assembling the first member and the second member in such a manner that each of the holes faces corresponding one of the opened spaces. At least one of the holes has a different diameter or length from that of another hole, and at least one of the opened spaces has a different volume from that of another opened spaces. Pairing of each of the holes and corresponding one of the opened spaces facing each other is changeable.

According to this, the frequencies of the sound absorbed by the Helmholtz resonators formed in the sound absorbing device can be changed by changing the pairing of each hole and the corresponding opened space facing each other, without replacing any members making up the Helmholtz resonators, as explained in the first and the second modifications.

Aspect J

In the sound absorbing device according to aspect I, the pairing of each of the holes such as the hole of each of the necks 1603*a* to 1603*f* and corresponding one of the opened spaces such as each of the opened spaces 1601*a* to 1601*f* facing each other is changed by changing the relative position of the second member such as the sound absorbing body member 610 with respect to the first member such as the sound absorbing cover member 620.

According to this, the frequencies of the sound absorbed by the Helmholtz resonators formed in the sound absorbing device can be changed by moving one of the first member and the second member relatively to the other, as explained in the first and the second modifications.

Aspect K

The sound absorbing device according to aspect J further includes a sound detecting unit such as a the microphone

1607 that is arranged on the first member such as the sound absorbing cover member 620 and detects sound; a cavity forming member moving unit such as the sound absorbing body member rotating motor 1606 that moves one of the first member or the second member such as the sound absorbing body member 610 relatively to the other; and a cavity forming member movement control unit such as the control unit 1650 that changes the relative position of the second member with respect to the first member, by controlling the cavity forming member moving unit based on a detection result of the sound detecting unit.

According to this the Helmholtz resonators can be automatically optimized to absorb the sound at a frequency nearest to the frequency intended to be absorbed, as explained in the first and the second modifications.

Aspect L

In the sound absorbing device according to aspect J or K, the holes such as the holes of the respective necks 1603*a* to 1603*f* and the opened spaces such as the opened spaces 1601*a* to 1601*f* are both circumferentially arranged.

According to this, the frequencies of the sound absorbed by the Helmholtz resonators formed in the sound absorbing device can be changed by rotating one of the first member such as the sound absorbing cover member 620 and the second member such as the sound absorbing body member 610 with respect to the other, as explained above in the first modification. Because the absorbed sound frequencies can be changed by rotating one of the members, the volume of the entire sound absorbing device including the Helmholtz absorbers remains the same. Therefore, the Helmholtz resonators can be arranged so as to make the best use of a limited space.

Aspect M

In the sound absorbing device according to aspect J or K, the holes such as the holes of the respective necks 1603*a* to 1603*f* and the opened spaces such as the opened spaces 1601*a* to 1601*f* are both linearly arranged.

According to this, the frequencies of the sound absorbed by the Helmholtz resonators formed in the sound absorbing device can be changed by linearly sliding one of the first member such as the sound absorbing cover member 620 and the second member such as the sound absorbing body member 610 with respect to the other, as explained above in the second modification. Because the absorbed sound frequencies can be changed by sliding one of the members, a sound absorbing device capable of changing the absorbed sound frequencies can be installed even when only a narrow space is available.

Aspect N

In the sound absorbing device according to any one of aspects I to M, one of the first member such as the sound absorbing cover member 620 and the second member such as the sound absorbing body member 610 is a magnet, and the other is a ferromagnetic body.

According to this, the first member and the second member can be closely bonded to each other with the magnetic force, as explained in the first and the second modifications. In this manner, pairing of each hole such as the hole of each of the necks 1603*a* to 1603*f* and corresponding one of the opened spaces such as each of the opened spaces 1601*a* to 1601*f* can be changed while ensuring the sealing of the cavities of the Helmholtz resonators.

Aspect O

In an electronic device such as a the copier 500 including a sound absorbing module that absorbs sound generated in the operations, the sound absorbing device such as the sound absorbing device 600 according to any one of aspects A to N is used as the sound absorbing module.

According to this, while using a sound absorbing unit such as the Helmholtz resonator 670 to absorb the sound generated in the operations of the electronic device, an increase of the sound at frequencies outside the frequency of the sound absorbed by the sound absorbing unit can be suppressed, as explained in the embodiments described above. In this manner, the effect of absorbing the sound generated in the operations of the electronic device can be improved.

Aspect P

An electrophotographic image forming apparatus such as the copier 500 is structured as the electronic device according to aspect O.

According to this, while using a sound absorbing unit such as the Helmholtz resonators to absorb the sound generated in the operations of the image forming apparatus, an increase in the sound at frequencies outside the frequency of the sound absorbed by the sound absorbing unit can be suppressed, as explained in the embodiments described above. In this manner, the effect of absorbing the sound generated in the operations of the image forming apparatus can be improved.

According to an embodiment, a sound absorbing device that includes a sound absorbing unit can suppress a volume increase of sound of frequencies outside the frequency of sound absorbed by the sound absorbing unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

8 photoconductor cleaning blade
9 neutralizing lamp
10 photoconductor
11 charging unit
12 developing device
13 transfer unit
14 cleaning unit
15 first belt stretching roller
16 second belt stretching roller
17 transfer belt
18 belt cleaning blade
20 toner supply unit
20*a* bottle setting hole
21 registration roller pair
22 thermal fixing unit
30 heating roller
32 pressing roller
34 ejecting bifurcating claw
35 ejecting roller
36 first pressing roller
37 second pressing roller
38 sheet-stiffening roller
39 the ejection stack unit
42 switchback unit
43 switchback roller pair
44 switchback position
47 laser writing device
48 polygon mirror
49 polygon motor
53 light source

54 mirror
55 image forming optical lens
56 image sensor
57 contact glass
60 recording sheet conveying unit
61 recording sheet cassette
61*a* recording sheet cassette outer cover
62 calling roller
63 supplying roller
64 separating roller
66 recording sheet conveyance roller pair
67 manual feed tray
68 manual feed unit
100 copier body
101 openable front cover
102 front inner cover
103 left side outer cover
121 developing roller
160 sound absorbing device attaching portion
200 image reading device
300 recording sheet bank
400 automatic document feeder
500 copier
510 front housing
510*a* sound absorbing device attaching opening
520 left housing
600 sound absorbing device
601, 601*a*-601*d* cavity
602 opening
603, 603*a*-603*d* communicating portion
610 sound absorbing body member
611, 611*a*-611*c* body side wall portion
620 sound absorbing cover member
623*a*-623*c* cavity top portion
625*a*-625*d* flange
630*a*-630*d* sound absorbing cap member
670 Helmholtz resonator
670*a* first resonator
670*b* second resonator
670*c* third resonator
670*d* fourth resonator
1601*a*-1601*f* opened space
1603*a*-1603*f* neck
1606 sound absorbing body member rotating motor
1606*a* rotational shaft
1607 microphone
1650 control unit
1670 rotated position detecting sensor
1680 storage unit
B transfer position
C transfer belt cleaning unit
P recording sheet
R recording sheet conveying path
R1 supply path
R2 manual feed path
R3 reversing path
R4 re-conveying path

CITATION LIST

Patent Documents

Patent Document 1: Japanese Patent Application Laid-open No. 2000-235396
Patent Document 2: Japanese Patent Application Laid-open No. 2000-112306
Patent Document 3: Japanese Patent No. 3816678
Patent Document 4: Japanese Patent Application Laid-open No. 2007-146852

The invention claimed is:

1. A sound absorbing device comprising:
a plurality of sound absorbers including necks forming openings and cavities;
a sound detector configured to detect a frequency of a sound;
a driver configured to change lengths of the necks with respect to the cavities; and
a controller configured to control driving of the driver based on a result of detection of the sound by the sound detector.

2. The sound absorbing device according to claim 1, wherein the necks are part of a first member forming the cavities with the lengths of the necks extending in a direction opposite to the cavities from the first member.

3. The sound absorbing device according to claim 2, wherein the sound detector is in the first member.

4. The sound absorbing device according to claim 1, wherein the frequency of the sound absorbed by the plurality of sound absorbers are adjusted by changing the lengths of the necks with respect to the cavities.

5. An electronic device comprising:
the sound absorbing device according to claim 1; and
a sound source configured to generate the sound.

6. An image forming apparatus comprising:
the electronic device according to claim 5, the electronic device configured to form an image on a recording medium.

7. The image forming apparatus of claim 6, wherein the sound is generated as a byproduct of operation of the electronic device.

* * * * *